US010103460B2

(12) United States Patent
Ono et al.

(10) Patent No.: US 10,103,460 B2
(45) Date of Patent: Oct. 16, 2018

(54) TERMINAL BLOCK

(71) Applicant: OMRON Corporation, Kyoto (JP)

(72) Inventors: Masahiro Ono, Okayama (JP); Taijiro Fujiwara, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 15/815,715

(22) Filed: Nov. 17, 2017

(65) Prior Publication Data

US 2018/0248283 A1 Aug. 30, 2018

(30) Foreign Application Priority Data

Feb. 28, 2017 (JP) ..... 2017-037550

(51) Int. Cl.
*H01R 4/52* (2006.01)
*H01R 12/51* (2011.01)
(Continued)

(52) U.S. Cl.
CPC ..... *H01R 12/515* (2013.01); *H01R 4/4809* (2013.01); *H01R 9/2416* (2013.01);
(Continued)

(58) Field of Classification Search
None
See application file for complete search history.

(56) References Cited

U.S. PATENT DOCUMENTS 6,074,221 A * 6/2000 Kajiwara ..... H01R 12/7076 439/495
6,146,217 A * 11/2000 Osada ..... H01R 4/4836 439/441
(Continued)

FOREIGN PATENT DOCUMENTS

DE 202013100740 3/2013
EP 1353407 10/2003
(Continued)

OTHER PUBLICATIONS

"Search Report of Europe Counterpart Application", dated May 4, 2018, p. 1-p. 5.

*Primary Examiner* — Truc Nguyen
(74) *Attorney, Agent, or Firm* — JCIPRNET

(57) ABSTRACT

The terminal block includes a movable operation feeling generating member (60) which generates an operation feeling according insertion of a conductor portion into an accommodating portion (12) from a first opening portion (111), and a first protruding portion (63) disposed in the accommodating portion to be capable of coming into contact with the movable operation feeling generating member being rotated by the insertion of the conductor portion into the accommodating portion from the first opening portion after the conductor portion and a terminal electrode portion (20) are changed from the non-connected state to the connected state. The movable operation feeling generating member includes a first contact portion (61) capable of coming into contact with the conductor portion inserted into the accommodating portion, and a second contact portion (62) which has a second protruding portion (70) generating the operation feeling by coming into contact with the first protruding portion (63).

6 Claims, 16 Drawing Sheets

(51) Int. Cl.

| | |
|---|---|
| ***H01R 9/26*** | (2006.01) |
| ***H01R 11/07*** | (2006.01) |
| ***H01R 4/48*** | (2006.01) |
| ***H01R 9/24*** | (2006.01) |
| ***H01R 13/58*** | (2006.01) |
| ***H01R 12/70*** | (2011.01) |

(52) U.S. Cl.
CPC ..... *H01R 9/2425* (2013.01); *H01R 9/2683* (2013.01); *H01R 11/07* (2013.01); *H01R 12/7064* (2013.01); *H01R 13/582* (2013.01); *H01R 4/52* (2013.01)

(56) References Cited

U.S. PATENT DOCUMENTS

| | | | | |
|---|---|---|---|---|
| 7,115,001 | B1 | 10/2006 | Brockman et al. | |
| 2005/0079773 | A1* | 4/2005 | Prokup | H01R 4/4809 439/709 |
| 2008/0233782 | A1* | 9/2008 | Hoppmann | H01R 4/4827 439/259 |
| 2009/0124139 | A1* | 5/2009 | Gerberding | H01R 4/4836 439/861 |
| 2010/0081316 | A1* | 4/2010 | Eppe | H01H 1/5844 439/441 |
| 2010/0304619 | A1* | 12/2010 | Joy | H01R 4/5008 439/682 |
| 2014/0370740 | A1* | 12/2014 | Kollmann | H01R 4/4836 439/438 |
| 2016/0056599 | A1* | 2/2016 | Peach | H01R 9/2666 439/508 |

FOREIGN PATENT DOCUMENTS

| | | |
|---|---|---|
| FR | 2720863 | 12/1995 |
| JP | 3098937 | 3/2004 |

* cited by examiner

TERMINAL BLOCK

CROSS-REFERENCE TO RELATED APPLICATION

This application claims the priority benefits of Japan Patent Application No. 2017-037550, filed on Feb. 28, 2017. The entirety of the above-mentioned patent applications is hereby incorporated by reference herein and made a part of this specification.

BACKGROUND OF THE DISCLOSURE

Field of the Disclosure

The disclosure relates to a push-in connection terminal block.

Description of Related Art

Patent Document 1 discloses a terminal block having a housing which includes a terminal connection surface having an opening through which an electric wire can be inserted and pulled out and a confirmation window disposed close to the opening, and an accommodating portion provided at an inside thereof and connected to the opening. In the terminal block, an elongated display body which rotates around a rotation axis approximately at a center in a direction intersecting with the terminal connection surface of the accommodating portion according to inserting/pulling-out of the electric wire is provided in the accommodating portion. In the display body, a display portion which is provided at one end thereof in a lengthwise direction and is disposed to be exposed from the confirmation window by rotation of the display body is integrally provided, and a user is informed of a connection state of the electric wire according to whether or not the display portion is exposed from the confirmation window.

RELATED ART DOCUMENT

Patent Documents

[Patent Document 1] Japanese Utility Model Registered Publication No. 3098937

SUMMARY OF THE DISCLOSURE

Provided is a terminal block according to one aspect of the disclosure including a housing which is an insulating housing, having a terminal connection surface in which a first opening portion through which a conductor portion of an electric wire is adapted to be inserted and pulled out and a second opening portion which is adjacent to the first opening portion and through which a jig is adapted to be inserted and pulled out are linearly arranged, and an accommodating portion which is provided therein and connected to the first opening portion and the second opening portion, a terminal electrode portion disposed in the accommodating portion and with which the conductor portion inserted into the accommodating portion from the first opening portion is able to come into contact, a leaf spring having a fixed portion formed at one end thereof to be fixed to the housing and an elastic portion formed at the other end thereof to be elastically deformable with respect to the fixed portion and disposed in the accommodating portion so that the elastic portion clamps the conductor portion inserted into the accommodating portion from the first opening portion with the terminal electrode portion to allow the conductor portion and the terminal electrode portion to be in a connected state and comes into contact with the jig inserted into the accommodating portion from the second opening portion to release contact between the elastic portion and the conductor portion and to allow the conductor portion and the terminal electrode portion to be in a non-connected state, a movable operation feeling generating member supported by the housing to be rotatable around a rotation axis disposed adjacent to the terminal electrode portion of the accommodating portion and extending in a direction intersecting an arrangement direction of the first opening portion and the second opening portion of the terminal connection surface and configured to rotate according insertion of the conductor portion into the accommodating portion from the first opening portion to generate an operation feeling, and a first protruding portion disposed in the accommodating portion to be capable of coming into contact with the movable operation feeling generating member being rotated by the insertion of the conductor portion into the accommodating portion from the first opening portion after the conductor portion and the terminal electrode portion are changed from the non-connected state to the connected state, wherein the movable operation feeling generating member includes a first contact portion which is capable of coming into contact with the conductor portion inserted into the accommodating portion from the first opening portion, and a second contact portion which is capable of coming into contact with the jig inserted into the accommodating portion from the second opening portion via the elastic portion and has a second protruding portion generating the operation feeling by coming into contact with the first protruding portion.

DESCRIPTION OF THE EMBODIMENTS

However, in the terminal block, for example, when connection of the electric wire is performed in a dark work environment, it is difficult to determine whether or not the display portion is exposed from the confirmation window, and there is a risk that the user cannot be informed of the accurate connection state of the electric wire.

Therefore, the disclosure accordingly provides a terminal block which is capable of accurately notifying a user of a connection state of an electric wire.

According to the terminal block of the aspect, the movable operation feeling generating member which is rotatable according the insertion of the conductor portion of the electric wire into the accommodating portion from the first opening portion, and a first protruding portion which is disposed in the accommodating portion to be capable of coming into contact with the movable operation feeling generating member being rotated by the insertion of the conductor portion into the accommodating portion from the first opening portion after the conductor portion and the terminal electrode portion are changed from the non-connected state to the connected state are provided. The second protruding portion which generates the operation feeling by coming into contact with the first protruding portion is provided at the movable operation feeling generating member. Accordingly, for example, even when the electric wire is connected to the terminal block in a dark work environment, the user can be accurately notified of the connection state of the electric wire by the operation feeling generated by the contact between the first protruding portion and the second protruding portion.

Hereinafter, an embodiment of the disclosure will be described with reference to the accompanying drawings. Further, in the following description, terms indicating a specific direction or position (for example, terms including "up," "down," "right," "left," "side," and "end") are used as necessary, but the use of these terms is intended to facilitate understanding of the disclosure with reference to the drawings, and the technical scope of the disclosure is not limited by the meanings of these terms. Furthermore, the following description is merely exemplary in nature and is not intended to limit the disclosure, an application thereof or a purpose thereof. Also, the drawings are schematic, and ratios of dimensions do not necessarily agree with actual ones.

First Embodiment

Figure 1:
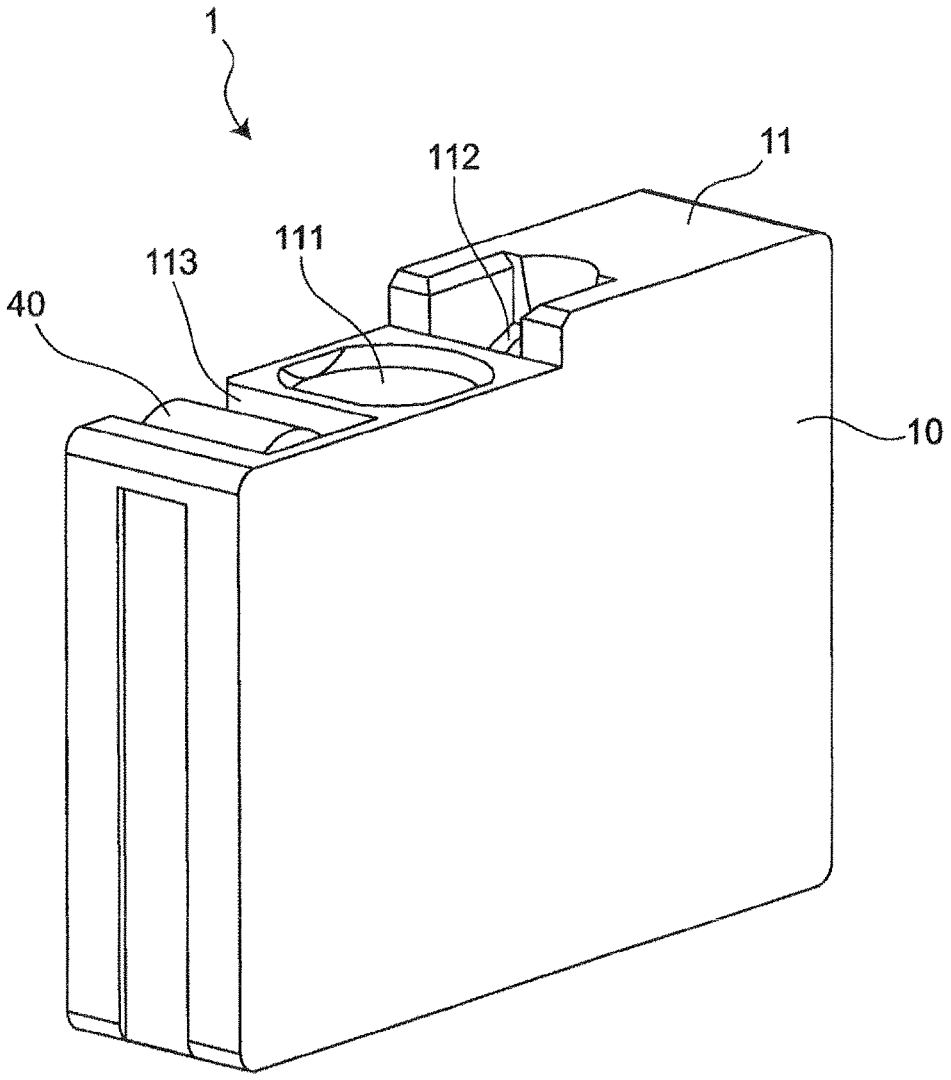
FIG. 1 is a perspective view of a terminal block according to a first embodiment of the disclosure.

As illustrated in FIG. 1, a terminal block 1 of the first embodiment includes an insulating housing 10 having a rectangular box shape. The housing 10 has a terminal connection surface 11 including a first opening portion 111 through which a conductor portion 81 (illustrated in FIGS. 6 and 7) of an electric wire 80 can be inserted and pulled out, a second opening portion 112 through which a jig 90 (illustrated in FIG. 7) can be inserted and pulled out, and a third opening portion 113.

In the terminal block 1, the terminal connection surface 11 is a rectangular surface formed on an upper portion of the housing 10 (an upper surface in FIG. 1), and the first opening portion 111, the second opening portion 112 and the third opening portion 113 are provided to be arranged linearly to be spaced apart from each other at intervals in a lengthwise direction of the terminal connection surface 11. The first opening portion 111 is disposed between the second opening portion 112 and the third opening portion 113. That is, each of the second opening portion 112 and the third opening portion 113 is adjacent to the first opening portion 111.

Figure 2:
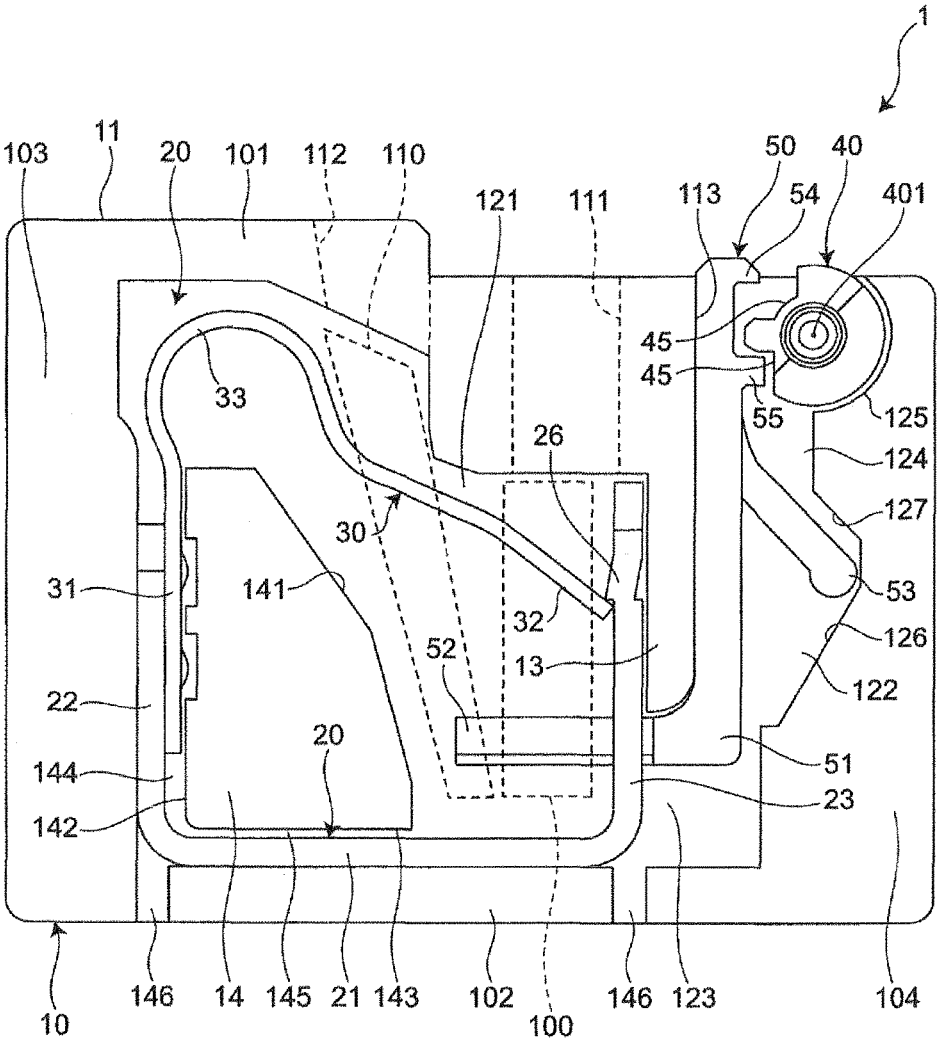
FIG. 2 is a front view of the terminal block of FIG. 1.

As illustrated in FIG. 2, the housing 10 includes a first wall portion 101 which has the terminal connection surface 11, a second wall portion 102 which faces the first wall portion 101, and a third wall portion 103 and a fourth wall portion 104 which are substantially orthogonal to the first wall portion 101 and the second wall portion 102 and face each other, and one surface thereof in a thickness direction (a surface on a near side in a drawing penetration direction in FIG. 2) is open.

Further, the housing 10 is provided in an inside surrounded by the first to fourth wall portions 101, 102, 103 and 104 and has an accommodating portion 12 connected to the first opening portion 111, the second opening portion 112 and the third opening portion 113. The accommodating portion 12 is configured with a first region 121 to which the first opening portion 111 and the second opening portion 112 are connected and a second region 122 to which the third opening portion 113 is connected, a terminal electrode portion 20 and a leaf spring 30 are accommodated in the first region 121, and a state display portion 40 and a movable display member 50 are accommodated in the second region 122. Furthermore, an inner surface of the second wall portion 102 facing the terminal connection surface 11 is defined as a bottom surface of the accommodating portion 12.

The first region 121 and the second region 122 of the accommodating portion 12 are partitioned by an electric wire insertion guide wall portion 13 which extends from the first opening portion 111 in a direction intersecting (substantially orthogonal to) the terminal connection surface 11 (a vertical direction in FIG. 2) to support the terminal electrode portion 20. Further, a first passage portion 123 connected to the first region 121 and the second region 122 is provided between the electric wire insertion guide wall portion 13 and the second wall portion 102.

An inclined wall portion 14 having an approximately trapezoid shape in a plan view in the thickness direction of the housing 10 is provided in the first region 121 of the accommodating portion 12. The inclined wall portion 14 includes a leaf spring inclined surface 141 which faces the electric wire insertion guide wall portion 13 and is inclined to approach the electric wire insertion guide wall portion 13 in an insertion direction (from an upper side toward a lower side in FIG. 2) of the electric wire 80, a first gap forming surface 142 which faces the third wall portion 103 and extends substantially in parallel with the electric wire insertion guide wall portion 13, and a second gap forming surface 143 which faces the second wall portion 102 and extends in a direction substantially orthogonal to the first gap forming surface 142.

An electric wire insertion region 100 which is a region in which the conductor portion 81 of the electric wire 80 may be inserted through the first opening portion 111, and a jig insertion region 110 which is a region in which the jig 90 may be inserted through the second opening portion 112 are provided between the leaf spring inclined surface 141 and the electric wire insertion guide wall portion 13. Gaps 144 and 145 in which the terminal electrode portion 20 can be disposed are respectively provided between the first gap forming surface 142 and the third wall portion 103 and between the second gap forming surface 143 and the second wall portion 102.

Also, two through-holes 146 which pass through the second wall portion 102 in the direction intersecting (for example, substantially orthogonal to) the terminal connection surface 11 and are connected to an outside of the housing 10 are provided in the second wall portion 102. The through-holes 146 are disposed in portions of the second wall portion 102 corresponding to both end portions of a horizontal plate portion 21 of the terminal electrode portion 20 which will be described later.

In the second region 122 of the accommodating portion 12, a second passage portion 124 which is defined by the electric wire insertion guide wall portion 13 and the fourth wall portion 104 and extends in the direction intersecting (substantially orthogonal to) the terminal connection surface 11 to be connected to the first passage portion 123 and the third opening portion 113 is provided. In the vicinity of the third opening portion 113 of the second passage portion 124, a display accommodating portion 125 for accommodating the state display portion 40 is provided.

Further, a first movable member inclined surface 126 and a second movable member inclined surface 127 are provided between the first passage portion 123 of the second passage portion 124 and the display accommodating portion 125. The first movable member inclined surface 126 is provided on the fourth wall portion 104 closer to the second wall portion 102 than the first wall portion 101 having the terminal connection surface 11 in the direction intersecting the terminal connection surface 11 and is inclined away from the electric wire insertion guide wall portion 13 as it approaches the third opening portion 113 of the terminal connection surface 11. The first movable member inclined surface 126 is in contact with an elastic arm portion 53 of the movable display member 50 to be described later and generates a biasing force for biasing the movable display member 50 toward the terminal connection surface 11. Also, the second movable member inclined surface 127 is provided on the fourth wall portion 104 closer to the first wall portion 101 than the second wall portion 102 in the direction intersecting the terminal connection surface 11 and is inclined to approach the electric wire insertion guide wall portion 13 as it approaches the third opening portion 113 of the terminal connection surface 11. The second movable member inclined surface 127 is in contact with the elastic arm portion 53 of the movable display member 50 and restricts movement of the movable display member 50 in a direction toward the terminal connection surface 11.

Figure 3:
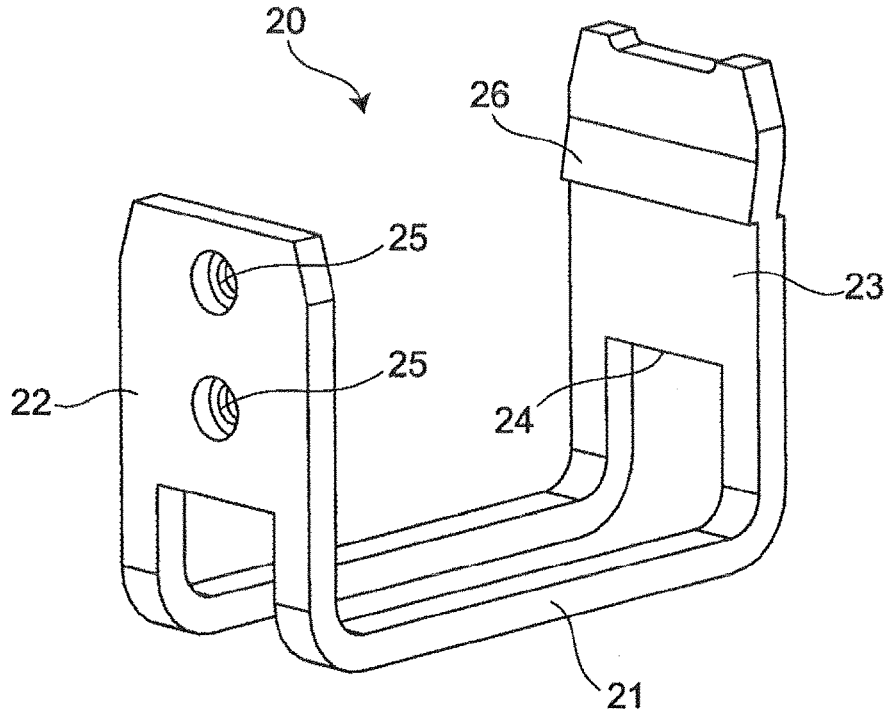
FIG. 3 is a front view of a state in which a conductor portion of an electric wire is inserted into the terminal block of FIG. 1.

As illustrated in FIGS. 2 and 3, the terminal electrode portion 20 is configured with the rectangular plate-like horizontal plate portion 21 which is a plate-like body having substantially a U shape in a plan view in the thickness direction of the housing 10 and extends substantially in parallel with the terminal connection surface 11, and a first vertical plate portion 22 and a second vertical plate portion 23 which extend from both longitudinal ends of the horizontal plate portion 21 in the direction substantially orthogonal to the terminal connection surface 11. As illustrated in FIG. 2, the horizontal plate portion 21 of the terminal electrode portion 20 is disposed in the gap 145 between the second gap forming surface 143 and the second wall portion 102, the first vertical plate portion 22 is disposed in the gap 144 between the first gap forming surface 142 and the third wall portion 103, and the second vertical plate portion 23 is disposed along the electric wire insertion guide wall portion 13.

As illustrated in FIG. 3, a rectangular through-hole 24 passing through the terminal electrode portion 20 in a plate thickness direction is provided in a center portion of the terminal electrode portion 20 in a width direction. The rectangular through-hole 24 extends over the horizontal plate portion 21 and a part of each of the vertical plate portions 22 and 23, and as illustrated in FIG. 2, a contact portion 52 of the movable display member 50 which will be described is disposed therein. A fixing hole 25 for fixing the terminal electrode portion 20 to the housing 10 with a fastening member (not illustrated) is provided in the first vertical plate portion 22. Also, a protruding portion 26 protruding toward the first vertical plate portion 22 is provided on the second vertical plate portion 23. In addition, the rectangular through-hole 24 of the second vertical plate portion 23 is provided so as not to hinder movement of the movable display member 50 in the direction intersecting the terminal connection surface 11.

As illustrated in FIG. 2, the leaf spring 30 includes a fixed portion 31 formed at one end thereof, an elastic portion 32 formed at the other end thereof to be elastically deformable with respect to the fixed portion 31, and a curved portion 33 connecting the fixed portion 31 and the elastic portion 32. The fixed portion 31 is fixed to the first vertical plate portion 22 of the terminal electrode portion 20. A plate surface of the elastic portion 32 has a shape corresponding to the leaf spring inclined surface 141 of the inclined wall portion 14, and a distal end thereof extends to the terminal electrode portion 20 and is in contact with the protruding portion 26. The elastic portion 32 is configured to pass (across) the electric wire insertion region 100 toward the fixed portion 31 and to be elastically deformable to the jig insertion region 110.

Figure 6:
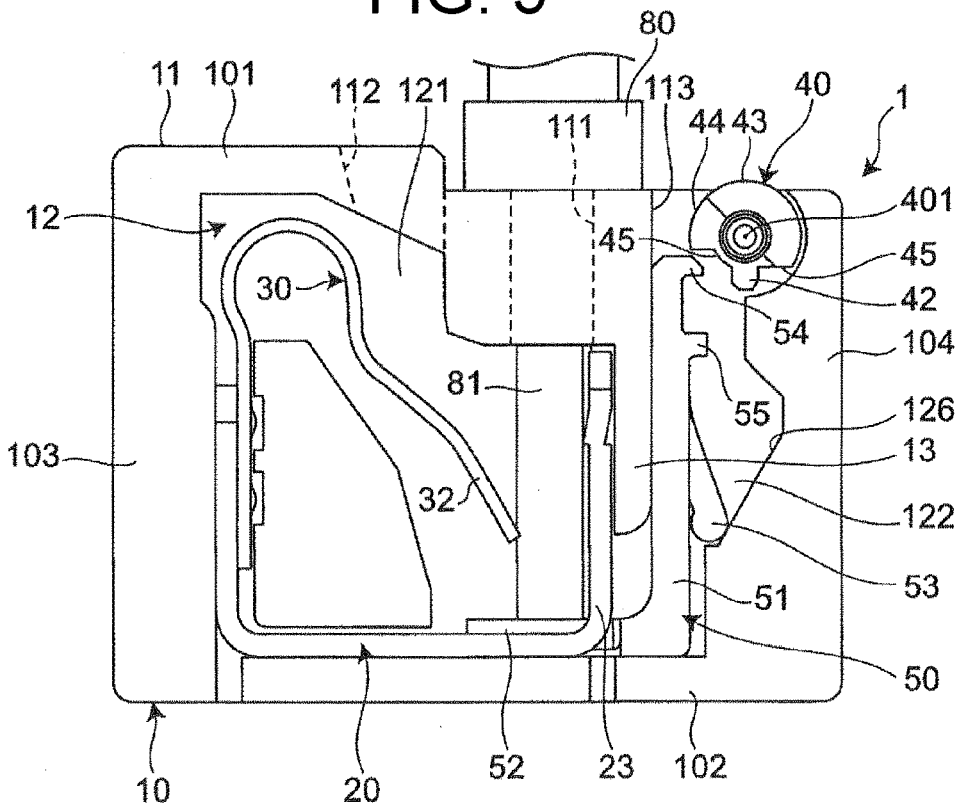
FIG. 6 is a perspective view of a movable display member of the terminal block of FIG. 1.

The elastic portion 32 clamps the conductor portion 81 of the electric wire 80 inserted into the first region 121 of the accommodating portion 12 via the first opening portion 111 with the second vertical plate portion 23 of the terminal electrode portion 20 so that the conductor portion 81 of the electric wire 80 and the terminal electrode portion 20 can be connected (refer to FIG. 6). Also, the elastic portion 32 comes into contact with the jig 90 inserted into the first region 121 of the accommodating portion 12 from the second opening portion 112 so that the contact between the elastic portion 32 and the conductor portion 81 of the electric wire 80 can be released (refer to FIG. 7).

As illustrated in FIG. 2, at the third opening portion 113, the state display portion 40 displays a connected state in which the conductor portion 81 of the electric wire 80 and the terminal electrode portion 20 are connected or a non-connected state in which the contact between the conductor portion 81 of the electric wire 80 and the terminal electrode portion 20 is released. The state display portion 40 is disposed in the display accommodating portion 125 of the second region 122 of the accommodating portion 12 and is supported by the housing 10 to be rotatable around a rotation axis 401 extending in a direction intersecting an arrangement direction from the first opening portion 111 of the terminal connection surface 11 to the third opening portion 113 thereof (that is, the drawing penetrating direction in FIG. 2).

Figure 4:
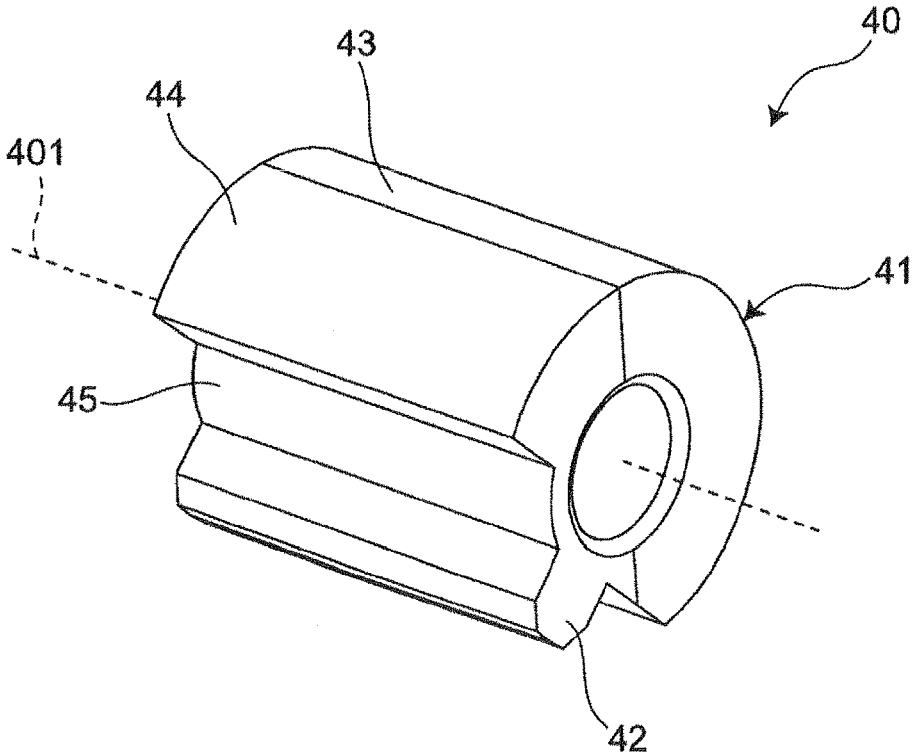
FIG. 4 is a front view of a state in which the conductor portion of the electric wire and a jig are inserted into the terminal block of FIG. 1.

Specifically, as illustrated in FIG. 4, the state display portion 40 includes a cylindrical body 41 of which a center axis is the rotation axis 401, and a cut-out portion 45 which is provided on a part of an outer circumference of the cylindrical body 41 and extends along the central axis. A protruding portion 42 which protrudes in a direction intersecting (substantially orthogonal to) the rotation axis 401 is provided at an intermediate portion of the outer circumference of the cylindrical body 41 in the cut-out portion 45. Further, a ratio of the cut-out portion 45 to an area of the cylindrical body 41 in a plan view in a direction of the rotation axis 401 is smaller than ½.

Furthermore, a connection display region 43 and a non-connection display region 44 are provided on an outer circumferential surface of the cylindrical body 41 with respect to the rotation axis 401 other than the cut-out portion 45. The connection display region 43 is, for example, a region which is colored with a conspicuous color such as red or yellow, and the non-connection display region 44 is, for example, a region which is colored with the same color as that of a material of the cylindrical body 41 (or a non-colored region when the state display portion 40 is formed of the same material as that of the cylindrical body 41). As illustrated in FIG. 2, a part of an outer circumferential surface of the state display portion 40 protrudes slightly from the terminal connection surface 11 toward an outside of the housing 10.

As illustrated in FIG. 2, the movable display member 50 includes a main body portion 51, the contact portion 52, the elastic arm portion 53 as an example of a biasing portion which is an example of a force transmitting portion, and a first pawl portion 54 and a second pawl portion 55 as an example of a rotating mechanism portion.

Figure 5:
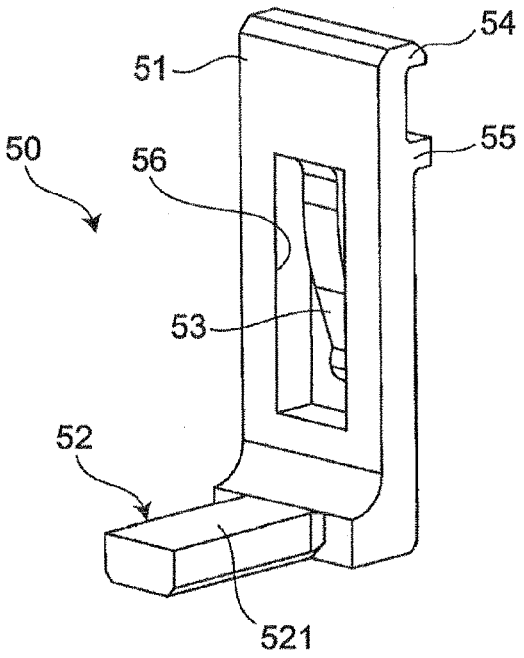
FIG. 5 is a perspective view of a terminal electrode portion of the terminal block of FIG. 1.

As illustrated in FIG. 2, the main body portion 51 has a substantially rectangular plate shape which extends in the direction intersecting (substantially orthogonal to) the terminal connection surface 11 and is disposed in the second passage portion 124 for capable of a reciprocating movement in the direction intersecting the terminal connection surface 11. As illustrated in FIG. 5, a through-hole 56 passing through the main body portion 51 in the plate thickness direction is provided at approximately a center of the main body portion 51.

As illustrated in FIG. 2, the contact portion 52 is provided to protrude from a lower end of the main body portion 51 in a lengthwise direction of a plate surface facing the electric wire insertion guide wall portion 13 toward the first region 121 and is disposed in the first passage portion 123. That is, the contact portion 52 is disposed adjacent to the terminal electrode portion 20 of the main body portion 51. As illustrated in FIG. 5, the contact portion 52 has a rectangular bar shape and also has a contact surface 521 on an upper surface thereof (that is, a surface facing the terminal connection surface 11). The contact surface 521 is disposed to be capable of coming into contact with the conductor portion 81 of the electric wire 80 inserted into the first region 121 of the accommodating portion 12 via the first opening portion 111.

When the conductor portion 81 of the electric wire 80 is inserted from the first opening portion 111 into the first region 121 of the accommodating portion 12, the contact portion 52 which is in contact with the conductor portion 81 of the electric wire 80 is pressed in a direction intersecting the terminal connection surface 11 and also away from the terminal connection surface 11 (a downward direction in FIG. 2). Accordingly, the contact portion 52 which is in contact with the conductor portion 81 of the electric wire 80 is pressed in a direction intersecting the terminal connection surface 11 and also away from the terminal connection surface 11, along with this, the main body portion 51 moves toward the second wall portion 102 (refer to FIG. 6).

As illustrated in FIG. 5, the elastic arm portion 53 is connected to an upper edge portion of the through-hole 56 of the main body portion 51 and extends along the second movable member inclined surface 127 from the main body portion 51 toward the fourth wall portion 104. The elastic aim portion 53 biases the main body portion 51 toward the terminal connection surface 11 when the conductor portion 81 of the electric wire 80 is inserted from the first opening portion 111 into the first region 121 of the accommodating portion 12. Specifically, when the conductor portion 81 of the electric wire 80 is inserted into the first region 121 of the accommodating portion 12 from the first opening portion 111 and the main body portion 51 moves toward the second wall portion 102, a distal end of the elastic arm portion 53 is in contact with the first movable member inclined surface 126 and is elastically deformed toward the main body portion 51. Due to the elastic deformation of the elastic arm portion 53, the main body portion 51 is biased toward the terminal connection surface 11 (refer to FIG. 6).

As illustrated in FIG. 2, the first pawl portion 54 and the second pawl portion 55 are disposed in the vicinity of the terminal connection surface 11 of the main body portion 51 and the state display portion 40 and rotate the state display portion 40 so that display of the state display portion 40 can be changed between the connected state and the non-connected state according to the reciprocating movement of the main body portion 51. Specifically, the first pawl portion 54 and the second pawl portion 55 extend in a direction in which the terminal connection surface 11 is arranged from the first opening portion to the third opening portion (in a left and right direction in FIG. 2) and are disposed to individually come into contact with the protruding portion 42 of the state display portion 40 with an interval therebetween by the reciprocating movement of the main body portion 51.

The first pawl portion 54 is disposed adjacent to the terminal connection surface 11 in a direction in which the main body portion 51 performs the reciprocating movement, that is, in a lengthwise direction of the main body portion 51 and protrudes from the plate surface of the main body portion 51 facing the fourth wall portion 104 toward the fourth wall portion 104. Further, the second pawl portion 55 is disposed further away from the terminal connection surface 11 than the first pawl portion 54 of the main body portion 51 in the lengthwise direction of the main body portion 51 and protrudes from the plate surface of the main body portion 51 facing the fourth wall portion 104 toward the fourth wall portion 104, similarly to the first pawl portion 54.

Also, the protruding portion 42 of the state display portion 40 is disposed between the first pawl portion 54 and the second pawl portion 55 so that one of the first pawl portion 54 and the second pawl portion 55 can be in contact with the protruding portion 42. That is, by the movement of the main body portion 51 in a direction away from the terminal connection surface 11 (the downward direction in FIG. 2), the first pawl portion 54 comes into contact with the protruding portion 42 in the cut-out portion 45 of the state display portion 40 and rotates the state display portion 40 to display the connected state (refer to FIG. 6), and by the movement of the main body portion 51 in a direction approaching the terminal connection surface 11 (an upward direction in FIG. 2), the first pawl portion 54 moves away from the protruding portion 42 in the cut-out portion 45 of the state display portion 40 and the second pawl portion 55 comes into contact with the protruding portion 42 and rotates the state display portion 40 to display the non-connected state (refer to FIG. 2).

Next, an operation of the terminal block 1 when the conductor portion 81 of the electric wire 80 is inserted into the first opening portion 111 and the jig 90 is inserted into the second opening portion 112 will be described with reference to FIGS. 2, 6 and 7.

When the conductor portion 81 of the electric wire 80 is inserted from the first opening portion 111 of the terminal block 1 into the electric wire insertion region 100 of the first region 121 of the accommodating portion 12, the conductor portion 81 of the inserted electric wire 80 is in contact with the elastic portion 32 of the leaf spring 30 and presses the elastic portion 32 of the leaf spring 30 in the direction away from the terminal connection surface 11. Therefore, the elastic portion 32 of the leaf spring 30 is elastically deformed against a spring force thereof, and the conductor portion 81 of the electric wire 80 is clamped between the elastic portion 32 of the leaf spring 30 and the second vertical plate portion 23 of the terminal electrode portion 20 as illustrated in FIG. 6, and the conductor portion 81 of the electric wire 80 and the terminal electrode portion 20 are in the connected state.

Further, when the conductor portion 81 of the electric wire 80 is inserted into the electric wire insertion region 100 of the first region 121 of the accommodating portion 12, the conductor portion 81 of the inserted electric wire 80 comes into contact with the contact surface 521 of the contact portion 52 of the movable display member 50 and presses the contact surface 521 of the contact portion 52 of the movable display member 50 until the contact portion 52 is in contact with the second wall portion 102 in the direction intersecting the terminal connection surface 11 and also away from the terminal connection surface 11, as illustrated in FIG. 6.

At this time, the main body portion 51 of the movable display member 50 is moved by the pressing of the conductor portion 81 of the inserted electric wire 80 toward the contact portion 52 in the direction intersecting the terminal connection surface 11 and also away from the terminal connection surface 11, and the first pawl portion 54 comes into contact with the protruding portion 42 of the state display portion 40 and rotates the state display portion 40 from a position illustrated in FIG. 2 (a position in which the protruding portion 42 extends substantially in parallel with the terminal connection surface 11) to a position illustrated in FIG. 6 (a position in which the protruding portion 42 extends in the direction substantially orthogonal to the terminal connection surface 11) in a counterclockwise direction in the plan view illustrated in FIG. 2. Accordingly, at least a part of the connection display region 43 is exposed from the third opening portion 113, and the connected state in which the conductor portion 81 of the electric wire 80 and the terminal electrode portion 20 are connected is displayed at the third opening portion 113.

Figure 7:
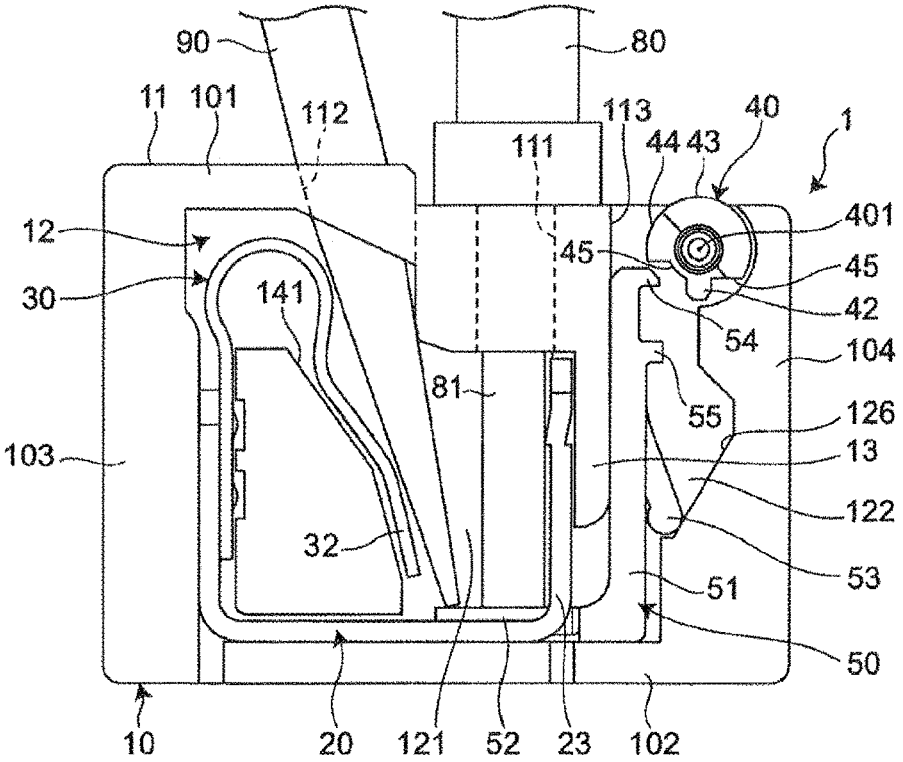
FIG. 7 is a perspective view of a state display portion of the terminal block of FIG. 1

Subsequently, when the jig 90 is inserted from the second opening portion 112 of the terminal block 1 in which the conductor portion 81 of the electric wire 80 and the terminal electrode portion 20 are in the connected state as illustrated in FIG. 6, a distal end of the jig 90 comes into contact with the elastic portion 32 of the leaf spring 30 to further elastically deform the elastic portion 32 of the leaf spring 30 against the spring force thereof as illustrated in FIG. 7. Accordingly, the contact between the elastic portion 32 of the leaf spring 30 and the conductor portion 81 of the electric wire 80 is released, and the conductor portion 81 of the electric wire 80 and the terminal electrode portion 20 are in the non-connected state. After that, the conductor portion 81 of the electric wire 80 in the accommodating portion 12 can be drawn out of the accommodating portion 12.

When the jig 90 in the accommodating portion 12 is drawn out from the accommodating portion 12 after the conductor portion 81 of the electric wire 80 in the accommodating portion 12 is pulled out to an outside of the accommodating portion 12, the elastic portion 32 of the leaf spring 30 which is elastically deformed by the jig 90 moves toward the second vertical plate portion 23 of the terminal electrode portion 20 due to the spring force and returns to the state illustrated in FIG. 2 in which the distal end thereof comes into contact with the protruding portion 26 of the second vertical plate portion 23 of the terminal electrode portion 20.

At this time, the pressing of the conductor portion 81 of the electric wire 80 and the jig 90 toward the contact portion 52 is released, and the elastic arm portion 53 which is elastically deformed while in contact with the first movable member inclined surface 126 biases the main body portion 51 toward the terminal connection surface 11. Therefore, the main body portion 51 moves in the direction intersecting the terminal connection surface 11 and approaching the terminal connection surface 11, and the second pawl portion 55 comes into contact with the protruding portion 42 of the state display portion 40 and rotates the state display portion 40 from the position illustrated in FIG. 6 to the position illustrated in FIG. 2 in a clockwise direction in the plan view illustrated in FIG. 2. As a result, the non-connection display region 44 is exposed from the third opening portion 113, and the fact that the conductor portion 81 of the electric wire 80 and the terminal electrode portion 20 are in the non-connected state is displayed at the third opening portion 113.

The terminal block 1 of the first embodiment includes the state display portion 40 which displays whether the conductor portion 81 and the terminal electrode portion 20 are in the connected state or the non-connected state at the third opening portion 113. Therefore, for example, even in a small-sized terminal block 1, the rotation region of the state display portion 40 can be secured in the accommodating portion 12, and the user can be notified of an accurate connection state of the electric wire 80.

Further, by the movement of the main body portion 51 in the direction intersecting the terminal connection surface 11 and away from the terminal connection surface 11, the first pawl portion 54 comes into contact with the protruding portion 42 in the cut-out portion 45 of the state display portion 40 and rotates the state display portion 40 to display the connected state, and by the movement of the main body portion 51 in the direction intersecting the terminal connection surface 11 and approaching the terminal connection surface 11, the second pawl portion 55 comes into contact with the protruding portion 42 in the cut-out portion 45 of the state display portion 40 and rotates the state display portion 40 to display the non-connected state. Accordingly, for example, even in the small-sized terminal block 1, the rotation region of the state display portion 40 can be sufficiently secured in the accommodating portion 12, and the user can be notified of a more accurate connection state of the electric wire 80.

Furthermore, in the connected state, the connection display region 43 of the state display portion 40 is disposed to be exposed from at least a part of the third opening portion 113. That is, when the connection display region 43 is exposed from at least a part of the third opening portion 113, the conductor portion 81 of the electric wire 80 and the terminal electrode portion 20 are disposed to be in the connected state. Accordingly, even in a smaller terminal block 1, the user can be notified of the accurate connection state of the electric wire 80.

Further, a part of the cylindrical body 41 of the state display portion 40 protrudes to the outside of the housing 10 from the third opening portion 113. Therefore, the connection display region 43 is easy to visually recognize, and the user can be notified more accurately of the connection state of the electric wire 80.

Further, the terminal electrode portion, the state display portion and the movable display member are not limited to the terminal electrode portion 20, the state display portion 40 and the movable display member 50 of the first embodiment. For example, a terminal electrode portion 120, a state display portion 140 and a movable display member 150 illustrated in FIGS. 9 to 11 may be adopted.

Figure 9:
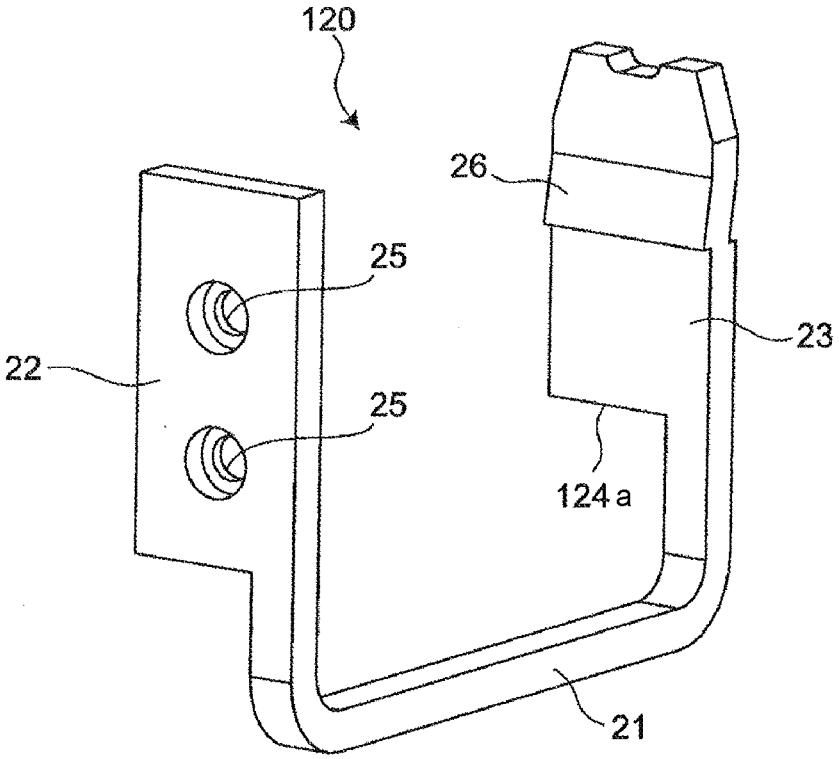
FIG. 9 is a perspective view of the terminal electrode portion of the terminal block of FIG. 8.
Figure 10:
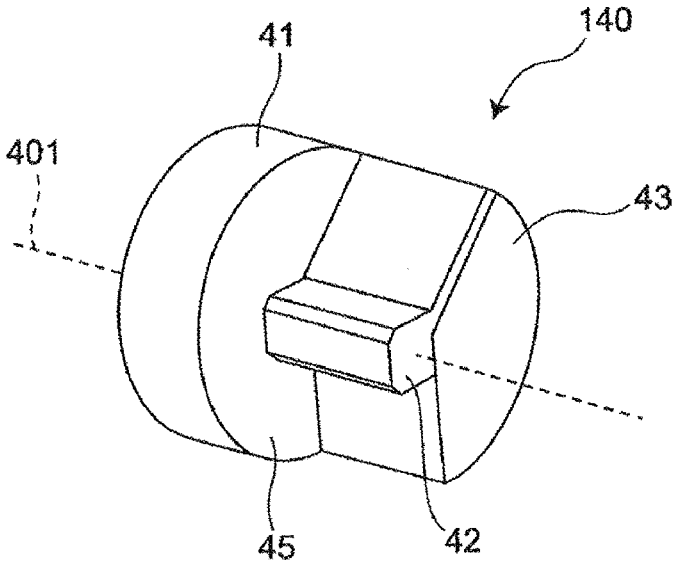
FIG. 10 is a perspective view of the movable display member of the terminal block of FIG. 8.

In the terminal electrode portion 120 illustrated in FIG. 9, a cut-out rectangular through-hole 124*a* which extends over the horizontal plate portion 21 and a part of each of the vertical plate portions 22 and 23 and of which one side in a width direction is connected to an outside are provided. The state display portion 140 illustrated in FIG. 10 is provided in a part of the cylindrical body 41 in the direction of the rotation axis 401 and has the cut-out portion 45 in which the ratio of the cut-out portion 45 to the area of the cylindrical body 41 in a plan view in the direction of the rotation axis 401 is larger than ½. In the state display portion 140, only the connection display region 43 is provided on the outer circumferential surface of the cylindrical body 41 other than the cut-out portion 45. In addition, the movable display member 150 illustrated in FIG. 11 has a long rod-shaped main body portion 151.

Figure 8:
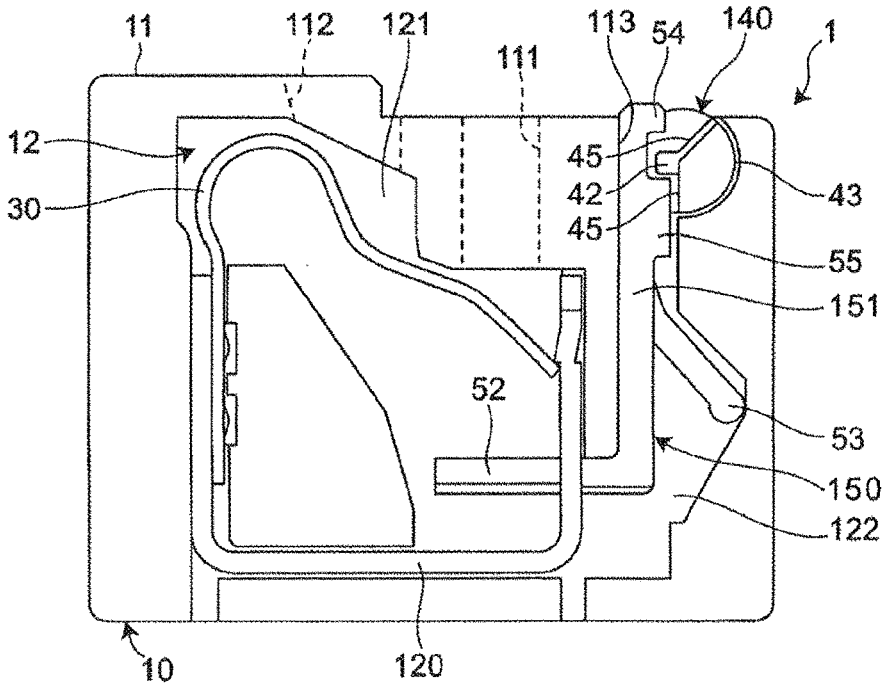
FIG. 8 is a front view of a modified example of the terminal block of FIG. 1.
Figure 11:
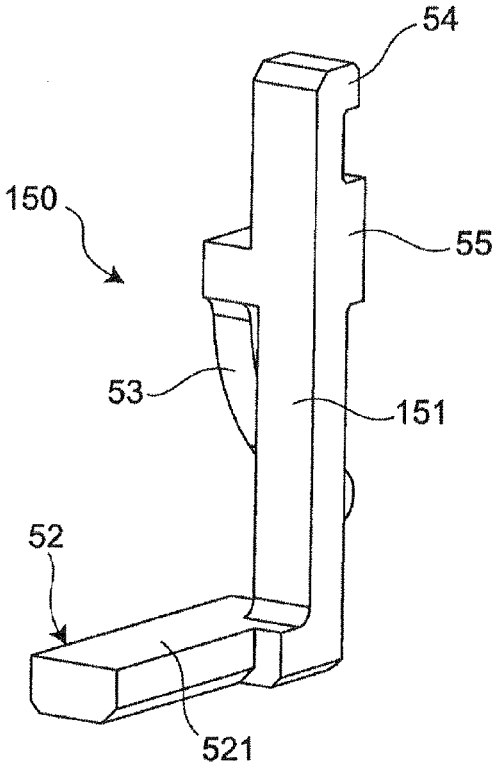
FIG. 11 is a perspective view of the state display portion of the terminal block of FIG. 8.
Figure 12:
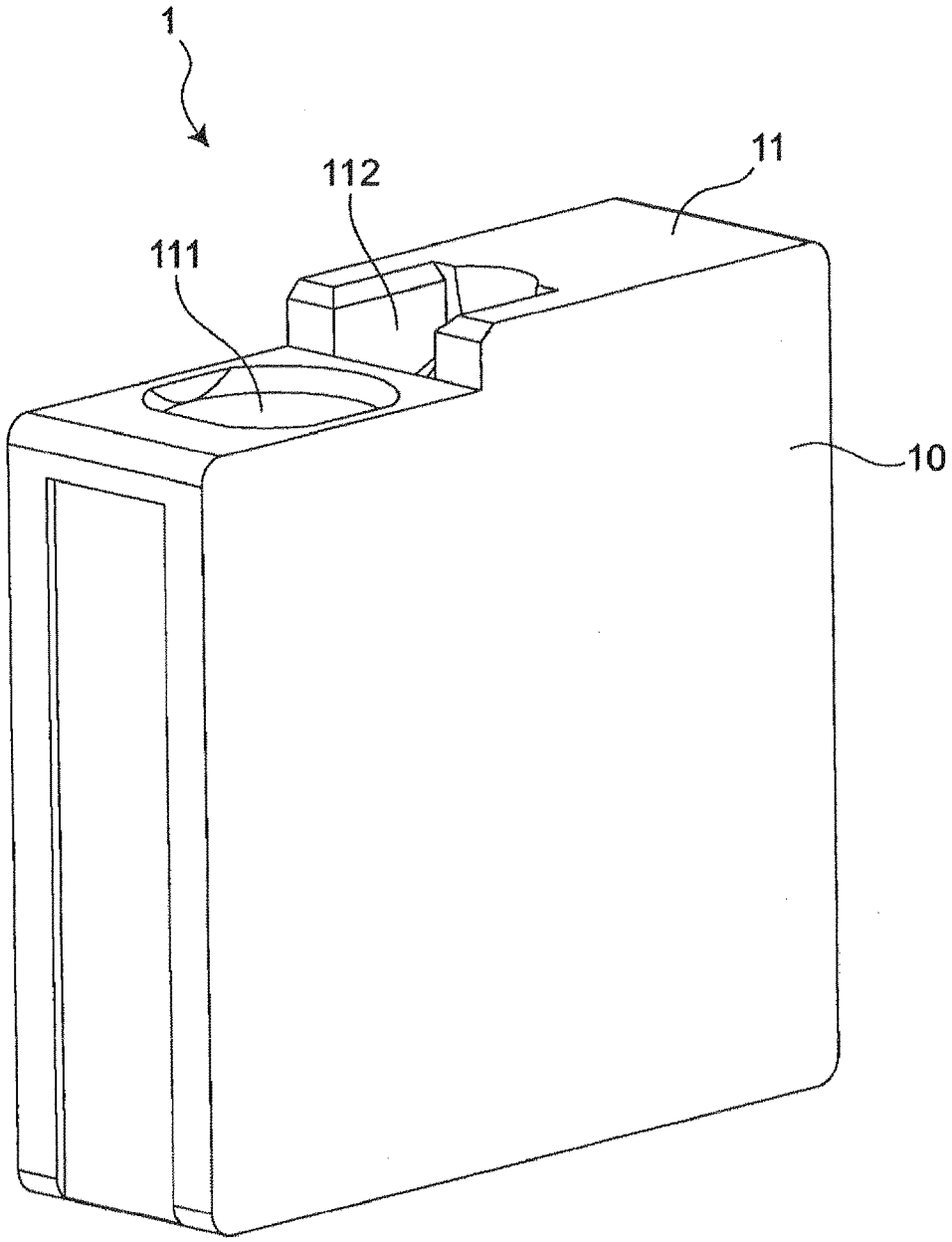
FIG. 12 is a perspective view of a terminal block according to a second embodiment of the disclosure.

As illustrated in FIG. 8, in the terminal block 1 including the terminal electrode portion 120, the state display portion 140 and the movable display member 150 illustrated in FIGS. 9 to 11, by the movement of the main body portion 151 of the movable display member 150 in a direction passing the cut-out portion 45, intersecting the terminal connection surface 11 and away from the terminal connection surface 11, the first pawl portion 54 comes into contact with the protruding portion 42 in the cut-out portion 45, and by the movement of the main body portion 151 in a direction passing the cut-out portion 45, intersecting the terminal connection surface 11 and approaching the terminal connection surface 11, the first pawl portion 54 moves away from the protruding portion 42 in the cut-out portion 45, and the second pawl portion 55 is disposed to come into contact with the protruding portion 42. Therefore, a space can be saved in the accommodating portion 12.

Further, the elastic aim portion 53 of the movable display member 50 is not limited to the case in which it is formed integrally with the main body portion 51 and may be formed separately from the main body portion 51.

In addition, the terminal connection surface 11 is not limited to the case in which it is configured with one plane, and each opening portion may be configured with a plurality of planes which are individually or arbitrarily combined and disposed.

Second Embodiment

As illustrated in FIGS. 12 to 16, a terminal block 1 of a second embodiment of the disclosure is different from that of the first embodiment in that a movable operation feeling generating member 60 having a second protruding portion 70, and a first protruding portion 63 are provided and the third opening portion 113 of the terminal connection surface 11, the second region 122 of the accommodating portion 12, the state display portion 40 and the movable display member 50 are not provided.

Further, in the second embodiment, the same reference numerals are assigned to the same parts as those of the first embodiment, the description thereof will be omitted, and the points different from the first embodiment will be described.

Figure 13:
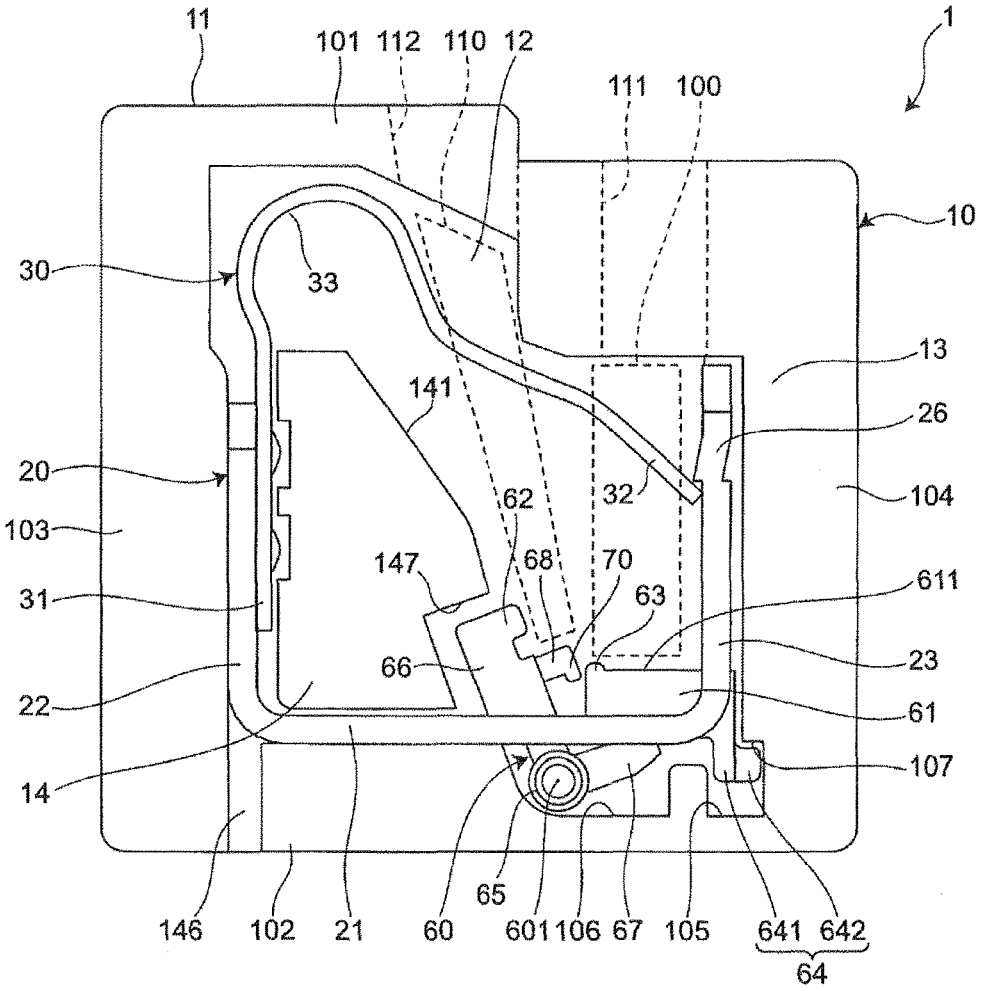
FIG. 13 is a front view of the terminal block of FIG. 12.

As illustrated in FIG. 13, in an inner surface (that is, the bottom surface of the accommodating portion 12) of the second wall portion 102 of the accommodating portion 12 of the housing 10, a first accommodating concave portion 105 disposed at an end on the fourth wall portion 104 side and a second accommodating concave portion 106 disposed on the third wall portion 103 side of the first accommodating concave portion 105 are provided. In the first accommodating concave portion 105, one of a pair of surfaces on the fourth wall portion 104 side, which extends in a direction intersecting (substantially orthogonal to) the terminal connection surface 11, is located at an outside of the inner surface of the fourth wall portion 104 to form a stepped portion 107.

An accommodating cut-out portion 147 which is open to the leaf spring inclined surface 141 is provided at an end of the leaf spring inclined surface 141 of the inclined wall portion 14 of the accommodating portion 12 on the second wall portion 102 side. Furthermore, in the terminal block 1 of the second embodiment, the fourth wall portion 104 also serves as the wire insertion guide wall portion 13.

As illustrated in FIG. 13, the movable operation feeling generating member 60 is disposed near the terminal electrode portion 20 of the accommodating portion 12, is supported by the housing 10 to be rotatable around a rotation axis 601 extending in a direction intersecting the direction in which the first opening portion 111 and the second opening portion 112 of the terminal connection surface 11 are arranged (a drawing penetration direction in FIG. 13), and is configured to be capable of generating an operation feeling by rotating as the conductor portion 81 (illustrated in FIGS. 15 and 16) of the electric wire 80 is inserted from the first opening portion 111 into the accommodating portion 12.

Figure 14:
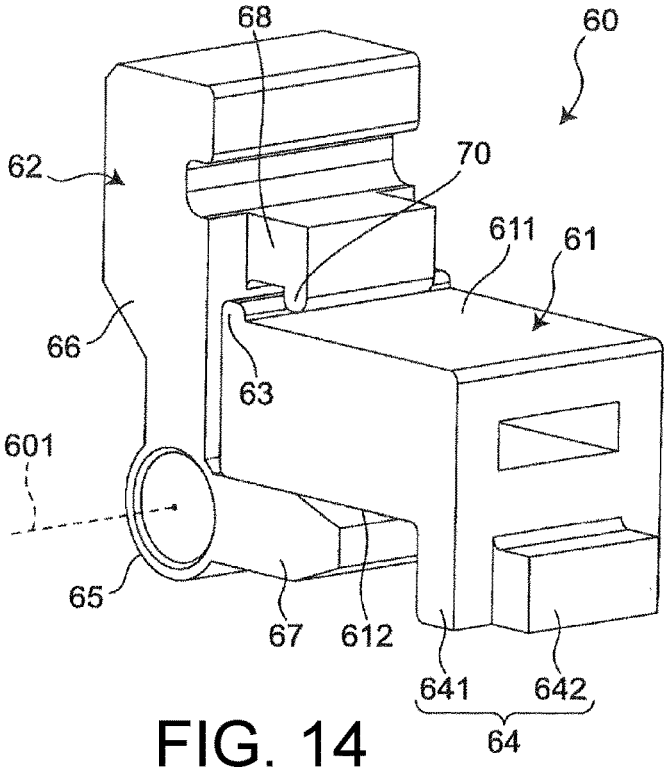
FIG. 14 is a perspective view of a movable operation feeling generating member of the terminal block of FIG. 12.

Specifically, as illustrated in FIG. 14, the movable operation feeling generating member 60 includes a first contact portion 61 which is capable of coming into contact with the conductor portion 81 of the electric wire 80 inserted into the accommodating portion 12 from the first opening portion 111, and a second contact portion 62 which is capable of coming into contact with the jig 90 (illustrated in FIG. 16) inserted into the accommodating portion 12 from the second opening portion 112 via the elastic portion 32 of the leaf spring 30 and has the second protruding portion 70 generating the operation feeling by coming into contact with the first protruding portion 63. The first contact portion 61 and the second contact portion 62 are formed separately.

The first contact portion 61 has a first surface 611 which is in contact with the conductor portion 81 of the electric wire 80 and a second surface 612 which faces the first surface. The first protruding portion 63 protruding from the first surface 611 toward the terminal connection surface 11 is provided on the first surface 611 of the first contact portion 61.

Further, a movement restricting portion 64 disposed in the first accommodating concave portion 105 of the accommodating portion 12 is provided on a second surface 612 of the first contact portion 61. The movement restricting portion 64 includes an arm portion 641 which extends from the second surface 612 in the direction intersecting (substantially orthogonal to) the terminal connection surface 11 and away from the terminal connection surface 11, and a protruding portion 642 which protrudes from the arm portion 641 toward the fourth wall portion 104. Movement of the first contact portion 61 in the direction approaching the terminal connection surface 11 is restricted by the protruding portion 642 and the stepped portion 107. That is, a movement range of the first contact portion 61 is restricted within the first accommodating concave portion 105 by the movement restricting portion 64.

The second contact portion 62 includes a rotating portion 65 in which the rotation axis 601 is disposed at a center thereof, a first member 66 which extends from the rotating portion 65 in a direction orthogonal to the rotation axis 601, and a second member 67 which extends from the rotating portion 65 in a direction orthogonal to the rotation axis 601 and intersecting an extending direction of the first member 66 and is in contact with the second surface 612 of the first contact portion 61.

The rotating portion 65 is disposed in the second accommodating concave portion 106 of the accommodating portion 12. Further, the first member 66 is disposed to extend toward the terminal connection surface 11, and the second member 67 is disposed to extend toward the fourth wall portion 104. In addition, as illustrated in FIG. 13, the first member 66 is accommodated in the accommodating cut-out portion 147 of the inclined wall portion 14 when the conductor portion 81 of the electric wire 80 and the terminal electrode portion 20 are in the non-connected state.

Further, the first member 66 has an arm portion 68 which extends in an extending direction of the second member 67. In the arm portion 68, the second protruding portion 70 protruding toward the second member 67 is provided at a distal end thereof which is apart from the first member 66.

Next, an operation of the terminal block 1 when the conductor portion 81 of the electric wire 80 is inserted into the first opening portion 111 and the jig 90 is inserted into the second opening portion 112 will be described with reference to FIGS. 13 and 15 to 17.

When the conductor portion 81 of the electric wire 80 is inserted from the first opening portion 111 of the terminal block 1 into the electric wire insertion region 100 of the accommodating portion 12, the conductor portion 81 of the inserted electric wire 80 is in contact with the elastic portion 32 and presses the elastic portion 32 of the leaf spring 30 in a direction away from the terminal connection surface 11. Accordingly, the elastic portion 32 of the leaf spring 30 is elastically deformed against the spring force, the conductor portion 81 of the electric wire 80 is clamped between the elastic portion 32 of the leaf spring 30 and the second vertical plate portion 23 of the terminal electrode portion 20, as illustrated in FIG. 15, and the conductor portion 81 of the electric wire 80 and the terminal electrode portion 20 are in the connected state.

Figure 15:
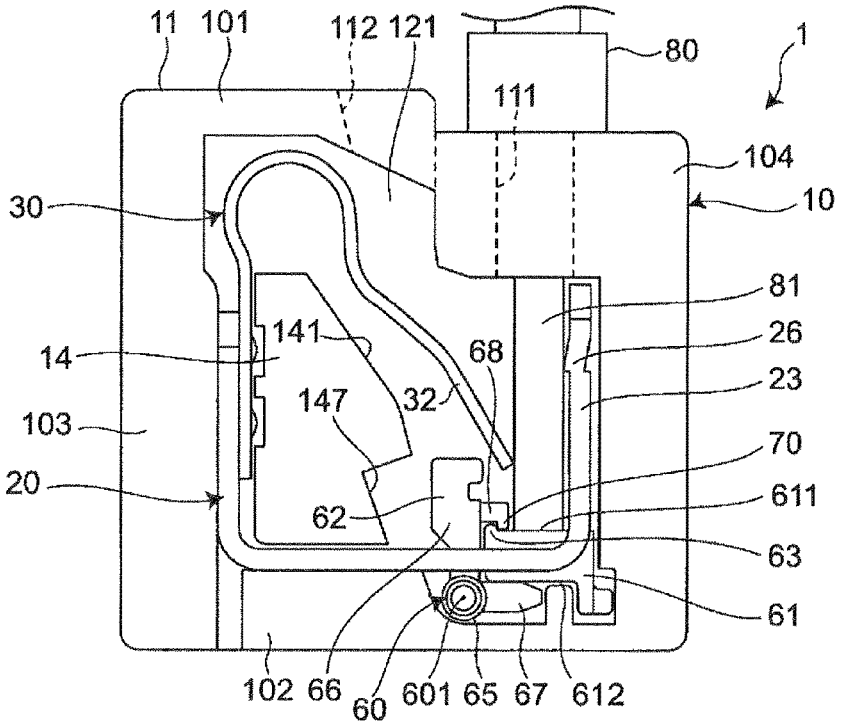
FIG. 15 is a front view of a state in which a conductor portion of an electric wire is inserted into the terminal block of FIG. 12.

Further, when the conductor portion 81 of the electric wire 80 is inserted into the electric wire insertion region 100 of the accommodating portion 12, the conductor portion 81 of the inserted electric wire 80 is in contact with the first contact portion 61 of the movable operation feeling generating member 60 and presses the first contact portion 61 of the movable operation feeling generating member 60 in the direction intersecting the terminal connection surface 11 and also away from the terminal connection surface 11 until the second surface 612 of the first contact portion 61 is in contact with the second wall portion 102, as illustrated in FIG. 15.

At this time, since the first contact portion is pressed by the conductor portion 81 of the electric wire 80, the second member 67 of the second contact portion 62 is pressed in the direction intersecting the terminal connection surface 11 and away from the terminal connection surface 11 and rotates the second contact portion 62 from a position illustrated in FIG. 13 (a position in which the first member 66 is accommodated in the accommodating cut-out portion 147 of the inclined wall portion 14) to a position illustrated in FIG. 15 (a position in which the first member 66 extends in a direction substantially orthogonal to the terminal connection surface 11) in a clockwise direction in the plan view illustrated in FIG. 13.

During rotation of the second contact portion 62 after the conductor portion 81 of the electric wire 80 and the terminal electrode portion 20 are changed from the non-connected state to the connected state, the second protruding portion 70 of the first member 66 of the second contact portion 62 comes in contact with the first protruding portion 63 of the first contact portion 61 to generate the operation feeling. That is, the user is informed that the conductor portion 81 and the terminal electrode portion 20 are changed from the non-connected state to the connected state due to the operation feeling. Further, the operation feeling is formed by a change in an insertion load of the conductor portion 81 of the electric wire 80 into the accommodating portion 12 until the second protruding portion 70 comes into contact with the first protruding portion 63 and passes over the first protruding portion 63, and a collision sound generated by collision of the second protruding portion 70 with the first surface 611 of the first contact portion 61 when the second protruding portion 70 passes over the first contact portion 61.

Figure 16:
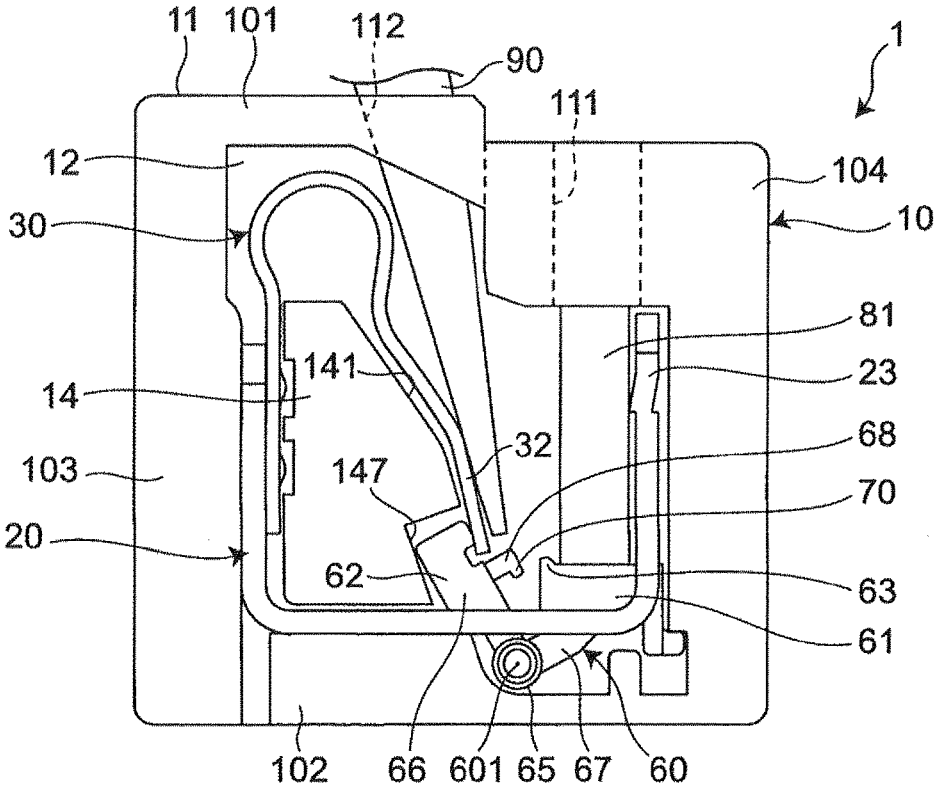
FIG. 16 is a front view of a state in which the conductor portion of the electric wire and a jig are inserted into the terminal block of FIG. 12.

Subsequently, when the jig 90 is inserted from the second opening portion 112 of the terminal block 1 in which the conductor portion 81 of the electric wire 80 and the terminal electrode portion 20 illustrated in FIG. 15 are in the connected state, the distal end of the jig 90 comes in contact with the elastic portion 32 of the leaf spring 30 and further elastically deforms the elastic portion 32 of the leaf spring 30 against the spring force thereof, as illustrated in FIG. 16. Accordingly, the contact between the elastic portion 32 of the leaf spring 30 and the conductor portion 81 of the electric wire 80 is released, and the conductor portion 81 of the electric wire 80 and the terminal electrode portion 20 are in the non-connected state. After that, the conductor portion 81 of the electric wire 80 in the accommodating portion 12 can be drawn out of the accommodating portion 12.

At this time, the first member 66 of the second contact portion 62 is pressed by the jig 90 toward the leaf spring inclined surface 141 of the inclined wall portion 14 via the leaf spring 30 and rotates the second contact portion 62 from the position illustrated in FIG. 15 to the position illustrated in FIG. 13 in the counterclockwise direction in the plan view illustrated in FIG. 13. Accordingly, the first member 66 of the second contact portion 62 is accommodated in the accommodating cut-out portion 147 of the inclined wall portion 14, and the movable operation feeling generating member 60 returns to the state illustrated in FIG. 13.

Figure 17:
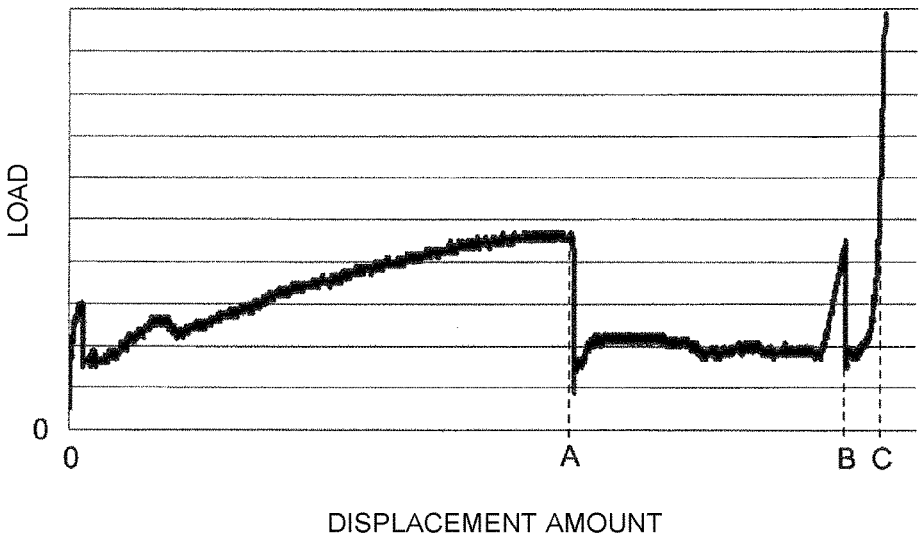
FIG. 17 is a view for explaining an operation feeling of the terminal block of FIG. 12.
Figure 18:
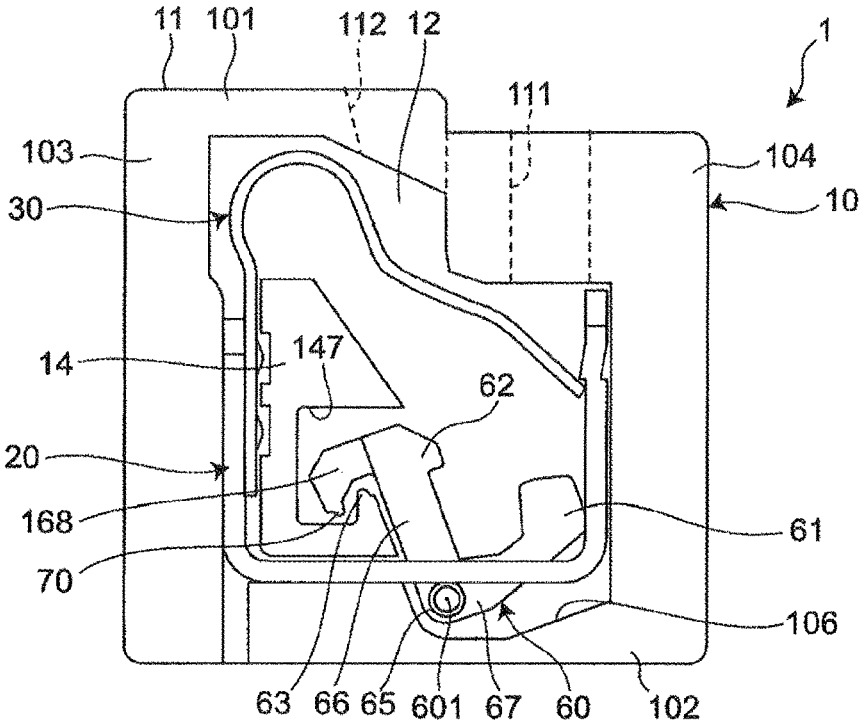
FIG. 18 is a front view of a modified example of the terminal block of FIG. 12.

Further, FIG. 17 illustrates the change in the insertion load when the conductor portion 81 of the electric wire 80 is inserted into the accommodating portion 12 to the position illustrated in FIG. 15. A vertical axis of FIG. 17 illustrates a load applied to the distal end of the conductor portion 81 of the electric wire 80, and a horizontal axis of FIG. 17 illustrates a position of the distal end of the conductor portion 81 of the electric wire 80 when the terminal connection surface 11 is set to a reference (=a displacement amount is zero).

As illustrated in FIG. 17, the load applied to the distal end of the conductor portion 81 of the electric wire 80 is increased as the conductor portion 81 of the electric wire 80 is inserted into the accommodating portion 12 from the first opening portion 111, and reaches a first peak when the distal end of the conductor portion 81 comes into contact with the distal end of the elastic portion 32 of the leaf spring 30 and the conductor portion 81 and the terminal electrode portion 20 are brought into the connected state (at a position of a displacement amount A).

Further, when the conductor portion 81 is inserted into the accommodating portion 12, the load applied to the distal end of the conductor portion 81 is reduced at once when the distal end of the conductor portion 81 passes over the distal end of the elastic portion 32 of the leaf spring 30, and the state remains for a while as it is.

Additionally, immediately before the second contact portion 62 is rotated by the insertion of the conductor portion 81 into the accommodating portion 12 and the second protruding portion 70 of the first member 66 of the second contact portion 62 comes into contact with the first protruding portion 63 of the first contact portion 61 and passes over the first protruding portion 63 (that is, a position of a displacement amount B), the load applied to the distal end of the conductor portion 81 reaches a second peak.

After that, when the conductor portion 81 is further inserted into the accommodating portion 12 and the second protruding portion 70 passes over the first protruding portion 63, the load applied to the distal end of the conductor portion 81 is reduced at once, and the first contact portion 61 comes into contact with the second wall portion 102 (=a position of a displacement amount C), and the insertion of the conductor portion 81 into the accommodating portion 12 is completed.

According to the terminal block 1 of the second embodiment, the movable operation feeling generating member 60 which is capable of rotating in accordance with the insertion of the conductor portion 81 from the first opening portion 111 into the accommodating portion 12, and the first protruding portion 63 which is disposed to be capable of coming into contact with the movable operation feeling generating member 60 being rotated by the insertion of the conductor portion 81 into the accommodating portion 12 from the first opening portion 111 after the conductor portion 81 and the terminal electrode portion 20 are changed from the non-connected state to the connected state are provided, and the second protruding portion 70 which comes into contact with the first protruding portion 63 and generates the operation feeling is provided on the movable operation feeling generating member 60. Accordingly, for example, even when the electric wire 80 is connected to the terminal block 1 in a dark work environment, the user can be notified of the accurate connection state of the electric wire 80 due to the operation feeling generated by the contact between the first protruding portion 63 and the second protruding portion 70.

Further, the first contact portion 61 and the second contact portion 62 are formed separately. Thus, for example, the first contact portion 61 and the second contact portion 62 can be formed of different materials, respectively, and it is possible to easily adjust the collision sound generated by the collision of the second protruding portion 70 with the first surface 611 of the first contact portion 61 when the second protruding portion 70 passes over the first contact portion 61.

Figure 19:
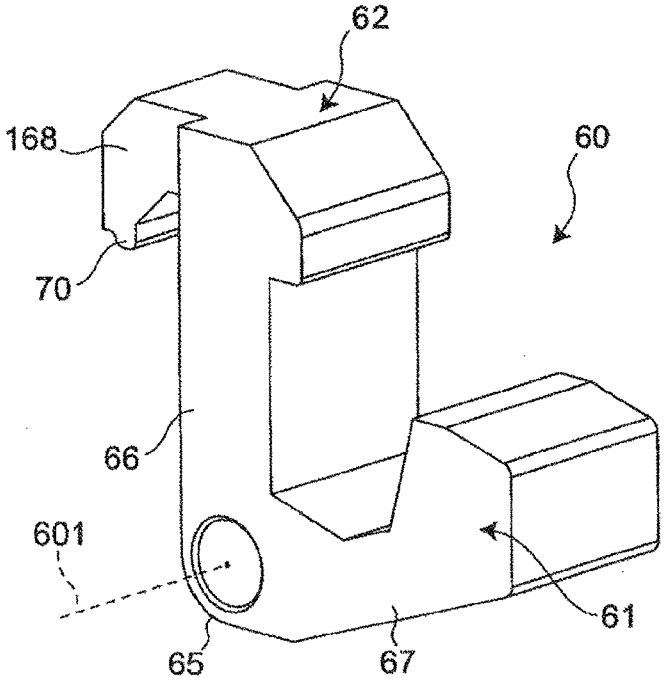
FIG. 19 is a perspective view of the movable operation feeling generating member of the terminal block of FIG. 18.
Figure 20:
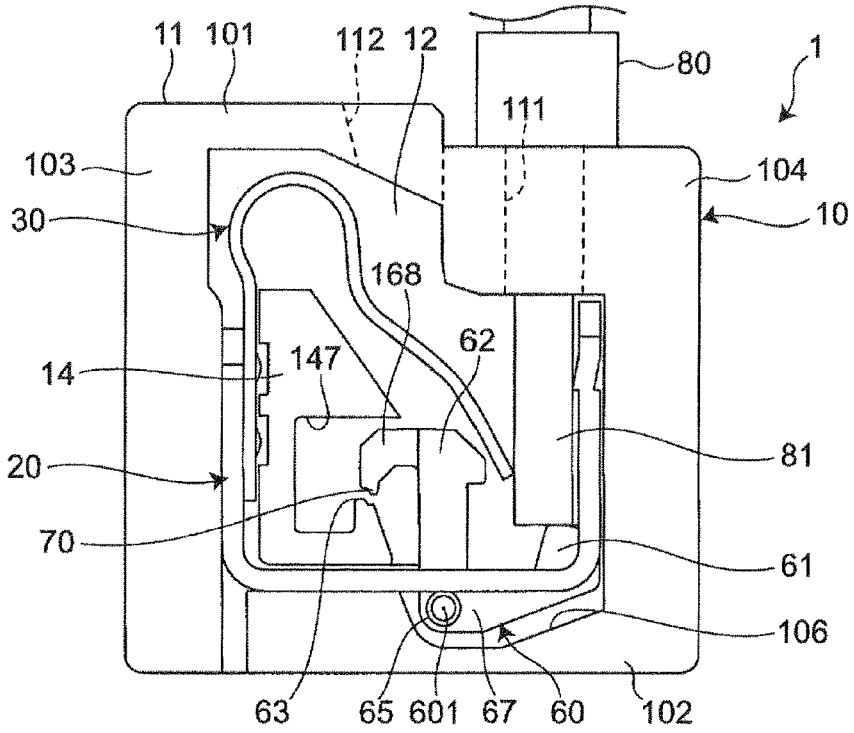
FIG. 20 is a front view of a state in which the conductor portion of the electric wire is inserted into the terminal block of FIG. 16.
Figure 21:
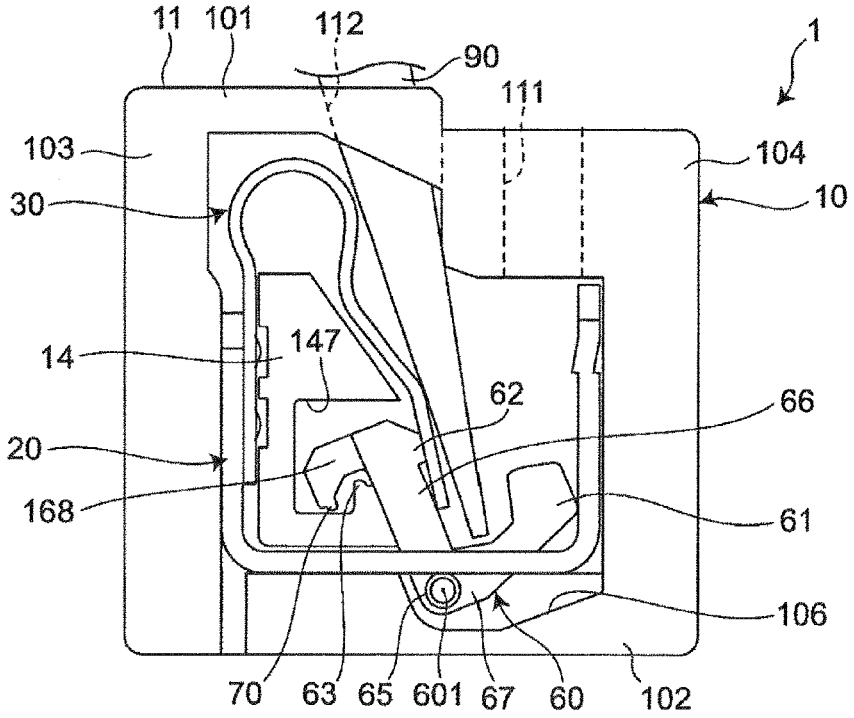
FIG. 21 is a front view of a state in which the conductor portion of the electric wire and a jig are inserted into the terminal block of FIG. 16.

The movable operation feeling generating member 60 is not limited to the case in which the first contact portion 61 and the second contact portion 62 are formed separately. For example, as illustrated in FIGS. 18 to 21, the first contact portion 61 and the second contact portion 62 can be integrally formed. In this case, as illustrated in FIG. 19, the first contact portion 61 is formed integrally with the second member 67 of the second contact portion 62, an arm portion 168 extending in a direction opposite to the first contact portion 61 (the second member 67) with respect to the rotating portion 65 (a left direction in FIG. 16) is formed on the first member 66 of the second contact portion 62, and the second protruding portion 70 protruding in an extending direction of the second contact portion 62 and in a direction approaching the rotating portion 65 is provided at a distal end of the arm portion 168 distant from the second contact portion 62. Furthermore, the first protruding portion 63 protruding toward the terminal connection surface 11 is provided on an opening edge of the accommodating cut-out portion 147 of the inclined wall portion 14 of the accommodating portion 12 on the second wall portion 102 side. Also, in the second wall portion 102, the first accommodating concave portion 105 is not provided, and only the second accommodating concave portion 106 is provided.

As described above, by integrally forming the first contact portion 61 and the second contact portion 62, the number of parts of the terminal block 1 can be reduced. Accordingly, it is possible to facilitate assembling of the terminal block 1 and to reduce

Third Embodiment

Figure 22:
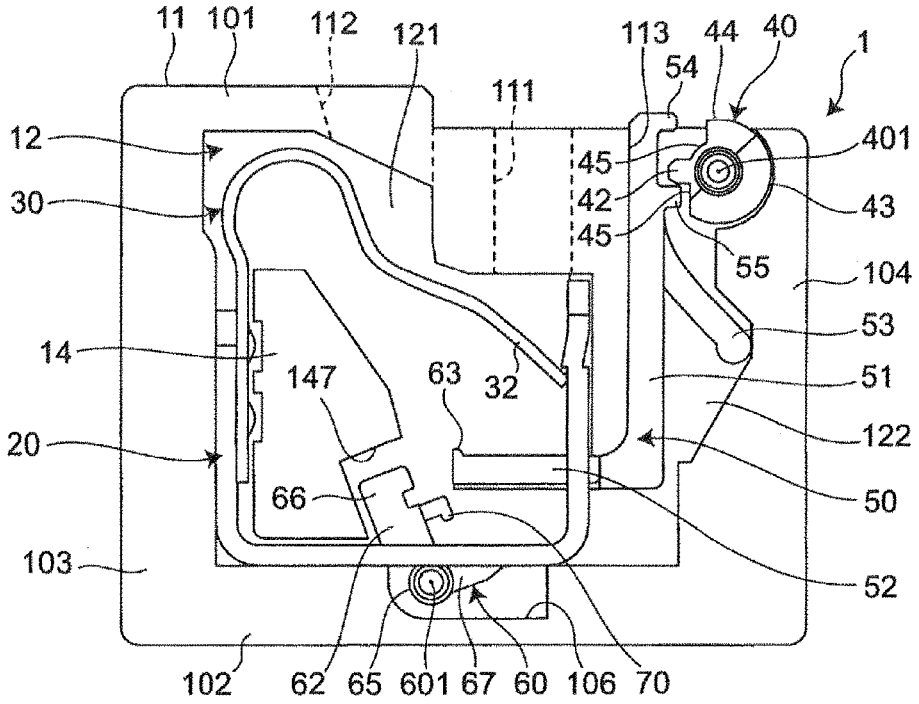
FIG. 22 is a plan view of a terminal block according to a third embodiment of the disclosure.
Figure 23:
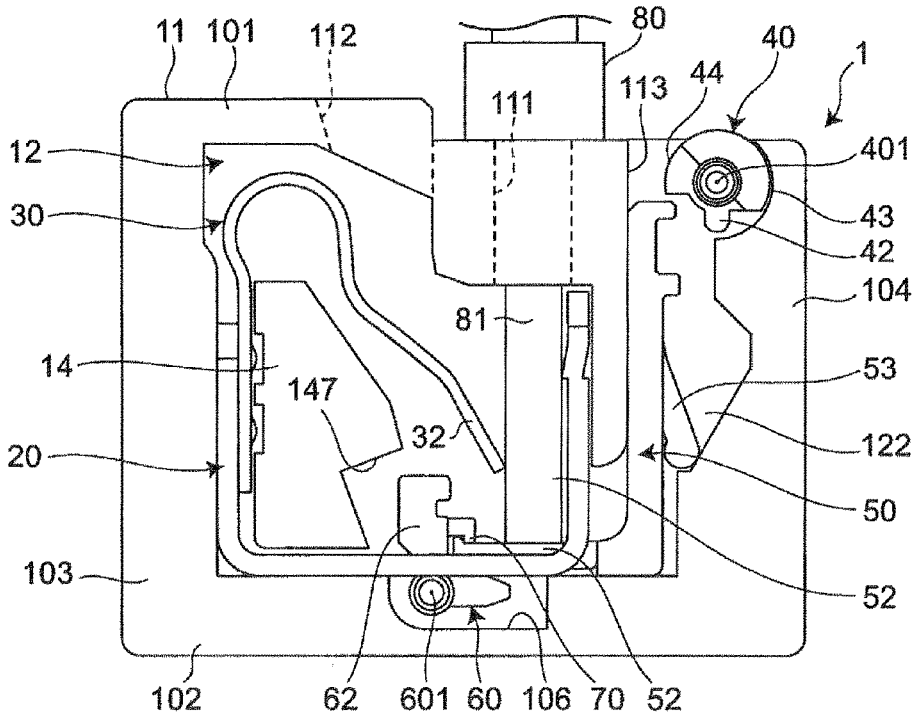
FIG. 23 is a front view of a state in which the conductor portion of the electric wire is inserted into the terminal block of FIG. 19.
Figure 24:
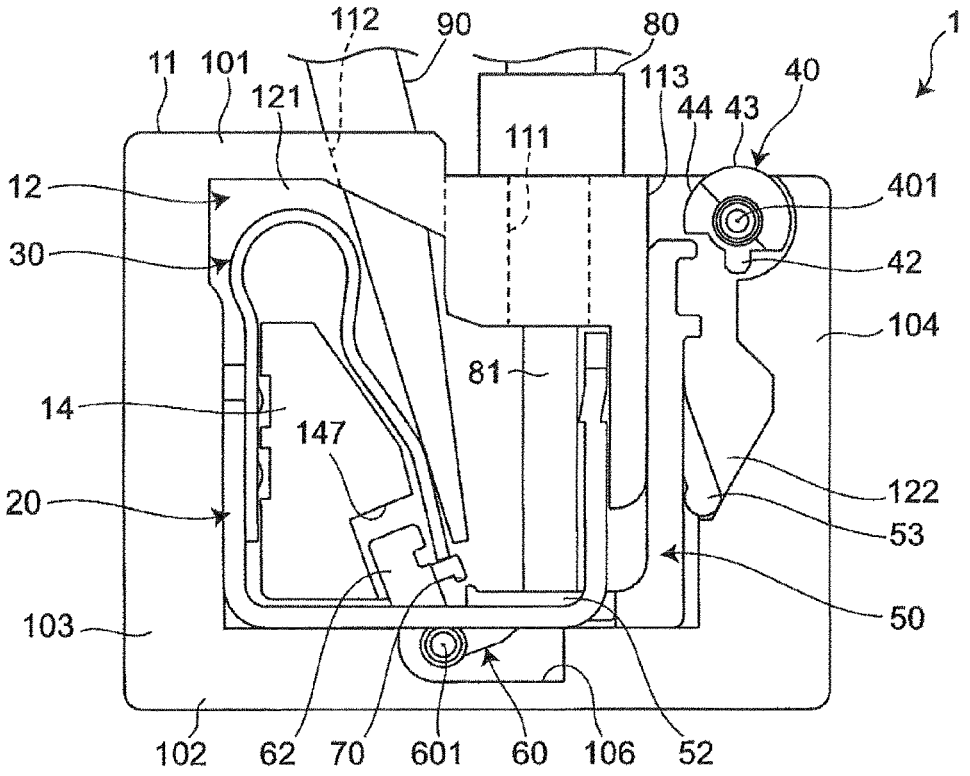
FIG. 24 is a front view of a state in which the conductor portion of the electric wire and a jig are inserted into the terminal block of FIG. 19.

As illustrated in FIGS. 22 to 24, a terminal block 1 of a third embodiment of the disclosure is different from those of the first embodiment and the second embodiment in that the movable operation feeling generating member 60 having the second protruding portion 70 of the second embodiment is included while the third opening portion 113 of the terminal connection surface 11, the second region 122 of the accommodating portion 12, the state display portion 40 and the movable display member 50 of the first embodiment are included.

Further, in the third embodiment, the same reference numerals are assigned to the same parts as those of the first embodiment and the second embodiment, and the description thereof will be omitted, and the points different from the first embodiment and the second embodiment will be described.

In the terminal block 1 of the third embodiment, the contact portion 52 of the movable display member 50 also serves as the first contact portion 61 of the movable operation feeling generating member 60. That is, the first protruding portion 63 is provided on the contact surface 521 of the contact portion 52 of the movable display member 50.

As described above, since the terminal block 1 includes the state display portion 40 and the movable display member 50, and the movable operation feeling generating member 60 having the second protruding portion 70, and the first protruding portion 63 of the second embodiment, the user can be notified of the connection state between the conductor portion 81 of the electric wire 80 and the terminal electrode portion 20 due to the generation of the operation feeling generated by the contact between the second protruding portion 70 of the movable operation feeling generating member 60 and the first protruding portion 63 in addition to the display of the state display portion 40. Accordingly, for example, even when the electric wire 80 is connected to the terminal block 1 in a work environment with a large noise and vibration, and even when the electric wire 80 is connected to the terminal block 1 in a dark work environment, the accurate connection state of the electric wire 80 can be notified to the user.

Further, the notification of the connected state by the state display portion 40, and the notification of the connected state due to the generation of the operation feeling by the contact between the second protruding portion 70 of the movable operation feeling generating member 60 and the first protruding portion 63 can be performed in an arbitrary order, for example, by adjusting a timing at which the first pawl portion 54 of the movable display member 50 and the protruding portion 42 of the state display portion 40 are in contact with each other.

For example, in a bright work environment with the large noise and vibration, the display by the state display portion 40 may be performed first, and the operation feeling due to the contact between the second protruding portion 70 of the movable operation feeling generating member 60 and the first protruding portion 63 may be generated later, and thus the notification with priority to visibility can be performed. Further, in the dark work environment with a small noise and vibration, the operation feeling due to the contact between the second protruding portion 70 of the movable operation feeling generating member 60 and the first protruding portion 63 may be generated first, and the display by the state display portion 40 may be performed later, and thus the notification with priority to the operation feeling can be performed. Furthermore, the display by the state display portion 40 and the generation of the operation feeling due to the contact between the second protruding portion 70 of the movable operation feeling generating member 60 and the first protruding portion 63 may be simultaneously performed, and it is possible to make the notifications appealing to multiple senses.

Various embodiments of the disclosure have been described in detail with reference to the drawings, but finally, various aspects of the disclosure will be described.

The terminal block of a first aspect of the disclosure includes an insulating housing having a terminal connection surface in which a first opening portion through which a conductor portion of an electric wire can be inserted and pulled out and a second opening portion which is adjacent to the first opening portion and through which a jig can be inserted and pulled out are linearly arranged, and an accommodating portion which is provided therein and connected to the first opening portion and the second opening portion, a terminal electrode portion disposed in the accommodating portion and with which the conductor portion inserted into the accommodating portion from the first opening portion is allowed to come into contact, a leaf spring having a fixed portion formed at one end thereof to be fixed to the housing and an elastic portion formed at the other end thereof to be elastically deformable with respect to the fixed portion and disposed in the accommodating portion so that the elastic portion clamps the conductor portion inserted into the accommodating portion from the first opening portion with the terminal electrode portion to allow the conductor portion and the terminal electrode portion to be in a connected state and comes into contact with the jig inserted into the accommodating portion from the second opening portion to release contact between the elastic portion and the conductor portion and to allow the conductor portion and the terminal electrode portion to be in a non-connected state, a movable operation feeling generating member supported by the housing to be rotatable around a rotation axis disposed adjacent to the terminal electrode portion of the accommodating portion and extending in a direction intersecting an arrangement direction of the first opening portion and the second opening portion of the terminal connection surface and configured to rotate according insertion of the conductor portion into the accommodating portion from the first opening portion to generate an operation feeling, and a first protruding portion disposed in the accommodating portion to be capable of coming into contact with the movable operation feeling generating member being rotated by the insertion of the conductor portion into the accommodating portion from the first opening portion after the conductor portion and the terminal electrode portion are changed from the non-connected state to the connected state, wherein the movable operation feeling generating member includes a first contact portion which is capable of coming into contact with the conductor portion inserted into the accommodating portion from the first opening portion, and a second contact portion which is capable of coming into contact with the jig inserted into the accommodating portion from the second opening potion via the elastic portion and has a second protruding portion generating the operation feeling by coming into contact with the first protruding portion.

According to the terminal block of the first aspect, the movable operation feeling generating member rotatable in accordance with the insertion of the conductor portion from the first opening portion into the accommodating portion, and the first protruding portion disposed to be capable of coming into contact with the movable operation feeling generating member being rotated by the insertion of the conductor portion into the accommodating portion from the first opening portion after the conductor portion and the terminal electrode portion are changed from the non-connected state to the connected state are included, and the second protruding portion which comes into contact with the first protruding portion and generates the operation feeling is provided at the movable operation feeling generating member. Accordingly, for example, even when the electric wire is connected to the terminal block in the dark work environment, the user can be accurately notified of the connection state of the electric wire by the operation feeling generated by the contact between the first protruding portion and the second protruding portion.

In the terminal block of a second aspect of the disclosure, the first contact portion and the second contact portion of the movable operation feeling generating member are formed separately, and the first contact portion has a first surface which is in contact with the conductor portion and a second surface which faces the first surface, and the second contact portion has a rotating portion in which a rotation axis is disposed at a center thereof, a first member which extends from the rotating portion in a direction orthogonal to the rotation axis, and a second member which extends from the rotating portion in a direction orthogonal to the rotation axis and intersecting an extending direction of the first member and is in contact with the second surface of the first contact portion, and the first member of the second contact portion has an arm portion which extends in an extending direction of the second member, and the second protruding portion which protrudes toward the second member is provided at a distal end of the arm portion away from the first member, and the first protruding portion which protrudes from the first surface is provided on the first surface of the first contact portion.

According to the terminal block of the second aspect, for example, the first contact portion and the second contact portion can be formed of different materials, respectively, and it is possible to easily adjust the collision sound generated by the collision with the first surface of the first contact portion when the second protruding portion passes over the first contact portion.

In the terminal block of a third aspect of the disclosure, the movable operation feeling generating member includes a rotating portion in which the rotation axis is disposed at a center thereof, the first contact portion which extends from the rotating portion in a direction orthogonal to the rotation axis, and the second contact portion which extends from the rotating portion in a direction orthogonal to the rotation axis and intersecting an extending direction of the first contact portion, and the rotating portion, the first contact portion and the second contact portion are formed integrally, and the second contact portion has an arm portion which extends in a direction opposite to the first contact portion with respect to the rotating portion, and the second protruding portion which protrudes in an extending direction of the second contact portion and also a direction approaching the rotating portion is provided at a distal end of the arm portion away from the second contact portion, and the first protruding portion is provided in the accommodating portion.

According to the terminal block of the third aspect, the number of parts of the terminal block can be reduced. Accordingly, assembling of the terminal block can be performed easily, and the manufacturing cost can be reduced.

In the terminal block of a fourth aspect of the disclosure, a third opening portion disposed in the terminal connection surface of the housing to be arranged linearly with the first opening portion and the second opening portion and connected to the accommodating portion is provided, and a state display portion supported by the housing to be rotatable around a rotation axis disposed adjacent to the terminal connection surface of the accommodating portion and extending in a direction intersecting an arrangement direction from the first opening portion of the terminal connection surface to the third opening portion thereof and configured to display whether the conductor portion and the terminal electrode portion are in the connected state or the non-connected state at the third opening portion, and a movable display member disposed in the accommodating portion and including a main body portion which extends in a direction intersecting the terminal connection surface and is capable of reciprocating movement in the direction intersecting the terminal connection surface, a contact portion which is connected adjacent to the terminal electrode portion of the main body portion and capable of coming into contact with the conductor portion inserted from the first opening portion into the accommodating portion, a biasing portion which is connected to the main body portion and biases the main body portion toward the terminal connection surface when the conductor portion is inserted from the first opening portion into the accommodating portion, and a rotating mechanism portion disposed adjacent to the terminal connection surface of the main body portion and also adjacent to the state display portion and configured to rotate the state display portion so that display of the state display portion can be changed between the connected state and the non-connected state according to the reciprocating movement of the main body portion are included.

According to the terminal block of the fourth aspect, for example, even when the electric wire is connected to the terminal block in a work environment with high noise and vibration, and even when the electric wire is connected to the terminal block in a dark work environment, the user can be notified of the accurate connection state of the electric wire Further, any of the various embodiments or modified examples described above may be appropriately combined to achieve the respective effects. Also, a combination of the embodiments or a combination of the embodiments or a combination of the embodiment and the embodiment is possible and a combination of features in different embodiments or examples is also possible.

The disclosure can be applied to, for example, a DIN (Deutsche Industrie Normen) rail mounting type terminal block.

What is claimed is:

1. A terminal block comprising:

a housing which is an insulating housing, having a terminal connection surface in which a first opening portion through which a conductor portion of an electric wire is adapted to be inserted and pulled out and a second opening portion which is adjacent to the first opening portion and through which a jig is adapted to be inserted and pulled out are linearly arranged, and an accommodating portion which is provided therein and connected to the first opening portion and the second opening portion, a terminal electrode portion disposed in the accommodating portion and with which the conductor portion inserted into the accommodating portion from the first opening portion is able to come into contact, a leaf spring having a fixed portion formed at one end thereof to be fixed to the housing and an elastic portion formed at the other end thereof to be elastically deformable with respect to the fixed portion and disposed in the accommodating portion so that the elastic portion clamps the conductor portion inserted into the accommodating portion from the first opening portion with the terminal electrode portion to allow the conductor portion and the terminal electrode portion to be in a connected state and comes into contact with the jig inserted into the accommodating portion from the second opening portion to release contact between the elastic portion and the conductor portion and to allow the conductor portion and the terminal electrode portion to be in a non-connected state, a movable operation feeling generating member supported by the housing to be rotatable around a rotation axis disposed adjacent to the terminal electrode portion of the accommodating portion and extending in a direction intersecting an arrangement direction of the first opening portion and the second opening portion of the terminal connection surface and configured to rotate according to insertion of the conductor portion into the accommodating portion from the first opening portion to generate an operation feeling, and a first protruding portion disposed in the accommodating portion to be capable of coming into contact with the movable operation feeling generating member being rotated by the insertion of the conductor portion into the accommodating portion from the first opening portion after the conductor portion and the terminal electrode portion are changed from the non-connected state to the connected state, wherein the movable operation feeling generating member includes a first contact portion which is capable of coming into contact with the conductor portion inserted into the accommodating portion from the first opening portion, and a second contact portion which is capable of coming into contact with the jig inserted into the accommodating portion from the second opening portion via the elastic portion and has a second protruding portion generating the operation feeling by coming into contact with the first protruding portion.

2. The terminal block according to claim 1, wherein the first contact portion and the second contact portion of the movable operation feeling generating member are formed separately, the first contact portion has a first surface which is in contact with the conductor portion and a second surface which faces the first surface, the second contact portion has a rotating portion in which the rotation axis is disposed at a center thereof, a first member which extends from the rotating portion in a direction orthogonal to the rotation axis, and a second member which extends from the rotating portion in a direction orthogonal to the rotation axis and intersecting an extending direction of the first member and is in contact with the second surface of the first contact portion, the first member of the second contact portion has an arm portion which extends in an extending direction of the second member, and the second protruding portion which protrudes toward the second member is provided at a distal end of the arm portion away from the first member, and the first protruding portion which protrudes from the first surface is provided on the first surface of the first contact portion.

3. The terminal block according to claim 1, wherein the movable operation feeling generating member includes a rotating portion in which the rotation axis is disposed at a center thereof, the first contact portion which extends from the rotating portion in a direction orthogonal to the rotation axis, and the second contact portion which extends from the rotating portion in a direction orthogonal to the rotation axis and intersecting an extending direction of the first contact portion, the rotating portion, the first contact portion and the second contact portion are formed integrally, the second contact portion has an arm portion which extends in a direction opposite to the first contact portion with respect to the rotating portion, and the second protruding portion which protrudes in an extending direction of the second contact portion and also a direction approaching the rotating portion is provided at a distal end of the arm portion away from the second contact portion, and the first protruding portion is provided in the accommodating portion.

4. The terminal block according to claim 1, wherein a third opening portion disposed in the terminal connection surface of the housing to be arranged linearly with the first opening portion and the second opening portion and connected to the accommodating portion is provided, and a state display portion supported by the housing to be rotatable around a rotation axis disposed adjacent to the terminal connection surface of the accommodating portion and extending in a direction intersecting an arrangement direction from the first opening portion of the terminal connection surface to the third opening portion thereof and configured to display whether the conductor portion and the terminal electrode portion are in the connected state or the non-connected state at the third opening portion, and a movable display member disposed in the accommodating portion and including a main body portion which extends in a direction intersecting the terminal connection surface and is capable of a reciprocating movement in the direction intersecting the terminal connection surface, a contact portion which is connected adjacent to the terminal electrode portion of the main body portion and capable of coming into contact with the conductor portion inserted from the first opening portion into the accommodating portion, a biasing portion which is connected to the main body portion and biases the main body portion toward the terminal connection surface when the conductor portion is inserted from the first opening portion into the accommodating portion, and a rotating mechanism portion disposed adjacent to the terminal connection surface of the main body portion and also adjacent to the state display portion and configured to rotate the state display portion so that display of the state display portion is adapted to be changed between the connected state and the non-connected state according to the reciprocating movement of the main body portion are included.

5. The terminal block according to claim 2, wherein a third opening portion disposed in the terminal connection surface of the housing to be arranged linearly with the first opening portion and the second opening portion and connected to the accommodating portion is provided, and a state display portion supported by the housing to be rotatable around a rotation axis disposed adjacent to the terminal connection surface of the accommodating portion and extending in a direction intersecting an arrangement direction from the first opening portion of the terminal connection surface to the third opening portion thereof and configured to display whether the conductor portion and the terminal electrode portion are in the connected state or the non-connected state at the third opening portion, and a movable display member disposed in the accommodating portion and including a main body portion which extends in a direction intersecting the terminal connection surface and is capable of a reciprocating movement in the direction intersecting the terminal connection surface, a contact portion which is connected adjacent to the terminal electrode portion of the main body portion and capable of coming into contact with the conductor portion inserted from the first opening portion into the accommodating portion, a biasing portion which is connected to the main body portion and biases the main body portion toward the terminal connection surface when the conductor portion is inserted from the first opening portion into the accommodating portion, and a rotating mechanism portion disposed adjacent to the terminal connection surface of the main body portion and also adjacent to the state display portion and configured to rotate the state display portion so that display of the state display portion is adapted to be changed between the connected state and the non-connected state according to the reciprocating movement of the main body portion are included.

6. The terminal block according to claim 3, wherein a third opening portion disposed in the terminal connection surface of the housing to be arranged linearly with the first opening portion and the second opening portion and connected to the accommodating portion is provided, and a state display portion supported by the housing to be rotatable around a rotation axis disposed adjacent to the terminal connection surface of the accommodating portion and extending in a direction intersecting an arrangement direction from the first opening portion of the terminal connection surface to the third opening portion thereof and configured to display whether the conductor portion and the terminal electrode portion are in the connected state or the non-connected state at the third opening portion, and a movable display member disposed in the accommodating portion and including a main body portion which extends in a direction intersecting the terminal connection surface and is capable of a reciprocating movement in the direction intersecting the terminal connection surface, a contact portion which is connected adjacent to the terminal electrode portion of the main body portion and capable of coming into contact with the conductor portion inserted from the first opening portion into the accommodating portion, a biasing portion which is connected to the main body portion and biases the main body portion toward the terminal connection surface when the conductor portion is inserted from the first opening portion into the accommodating portion, and a rotating mechanism portion disposed adjacent to the terminal connection surface of the main body portion and also adjacent to the state display portion and configured to rotate the state display portion so that display of the state display portion is adapted to be changed between the connected state and the non-connected state according to the reciprocating movement of the main body portion are included.

* * * * *